US007162171B2

(12) United States Patent
Sugiyama

(10) Patent No.: US 7,162,171 B2
(45) Date of Patent: Jan. 9, 2007

(54) METHOD, SYSTEM AND SOFTWARE PROGRAM FOR CORRECTING POSITIONAL COLOR MISALIGNMENT

(75) Inventor: Mitsugu Sugiyama, Yokohama (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 10/922,341

(22) Filed: Aug. 20, 2004

(65) Prior Publication Data

US 2005/0041990 A1 Feb. 24, 2005

(30) Foreign Application Priority Data

Aug. 22, 2003 (JP) ..... 2003-298077
Sep. 18, 2003 (JP) ..... 2003-326556

(51) Int. Cl.
*G03G 15/00* (2006.01)

(52) U.S. Cl. ..... 399/49; 399/72

(58) Field of Classification Search ..... 399/49
See application file for complete search history.

(56) References Cited

U.S. PATENT DOCUMENTS 5,510,885 A * 4/1996 Mori et al. ..... 399/28
6,128,459 A 10/2000 Iwata et al.
6,282,396 B1 8/2001 Iwata et al.
6,295,435 B1 9/2001 Shinohara et al.
6,381,435 B1 4/2002 Shinohara et al.
6,633,734 B1 * 10/2003 Maebashi et al. ..... 399/49
2003/0091356 A1 * 5/2003 Komatsu et al. ..... 399/49
2004/0095454 A1 * 5/2004 Maeda ..... 347/116
2005/0041990 A1 * 2/2005 Sugiyama ..... 399/49
2005/0093962 A1 * 5/2005 Miyatake et al. ..... 347/235

FOREIGN PATENT DOCUMENTS

JP 07-181795 7/1995
JP 10-260567 9/1998
JP 2002-014505 1/2002

* cited by examiner

*Primary Examiner*—David M. Gray
*Assistant Examiner*—Ryan D. Walsh
(74) *Attorney, Agent, or Firm*—Knoble Yoshida Dunleavy, LLC

(57) ABSTRACT

A color image forming apparatus generally includes a plurality of image forming units for each generating an image in a predetermined color. Since these images in various colors are placed on top of each other in an overlapping manner, the positional placement of these images is critical. To correct the misalignment in an efficient manner, a new technique is disclosed to perform the density determination in advance of the misalignment correction. The previously detected density level is stored prior to determine the positional misalignment among the color image forming units.

58 Claims, 16 Drawing Sheets

METHOD, SYSTEM AND SOFTWARE PROGRAM FOR CORRECTING POSITIONAL COLOR MISALIGNMENT

FIELD OF THE INVENTION

The current invention is generally related to a color image-forming device such as a copier and a printer, and more particularly related to the correction of the color positional misalignment in the color image forming device.

BACKGROUND OF THE INVENTION

In the prior art techniques, a color image forming device utilizes a tandem method of successively transferring an image that has been formed by the electrophotographic process onto transferring paper on a transfer belt. A plurality of image forming units includes a cyan image forming unit, a magenta image forming unit, a yellow image forming unit and a black image forming unit, and each of the image forming units is equipped with a writing sub-unit and an image forming sub-unit for forming a static image on a photoreceptor drum by a modulated laser according to the corresponding image data. Subsequently, each of the image forming units supplies corresponding color toner onto the photoreceptor according to the static image. Finally, the formed toner image is successively transferred onto an image-forming medium on the transfer belt in an overlapping manner so as to form a full color image.

In general, the misalignment is grouped either angled misalignment or parallel misalignments. The angled misalignments are caused by an erroneous positioning of the optical system, the image forming units and the photoreceptor drum with respect to the color image forming device body. The angled misalignments are generally corrected by adjusting the position of a reflective mirror in the writing unit. The parallel misalignments are caused by an erroneous positioning of the main-running direction with respect to a predetermined standard line. The parallel misalignments are generally corrected by adjusting the writing timing of the main-running direction or the sub-running direction. The length of the image along the main-running direction is also adjusted by the frequency of the writing pixels to correct a scaling error.

In the above tandem method, color misalignments also occur for various reasons. In comparison to a single drum method, the tandem method requires the successive and overlapping color toner transfer onto the same image forming medium. Although the tandem method operates at a high printing speed, it is difficult to align the colors. For example, when a user or a repairman accidentally moves a part of the electrophotographic components from the predetermined position in response to a paper jam, even if the moved component is put back to a supposedly original position, a minute positional difference causes a color misalignment. When the color toner fails to transfer at an exactly predetermined position from each of the image forming units, the formed full color image contains undesirable color overlapped portions which are not in intended colors. The color may undesirably appear faded or darkened in these portions. In other situations, the portions contain undesired gaps or overlaps.

In order to correct the color positional misalignment in the above described color image forming device, the printing task is interrupted, and position detection patterns are formed on the transfer belt so that CCD sensors detect the position detection patterns in order to determine an amount of the color positional misalignment for the correction. The position detection patterns vary in density and uniformity due to the environmental changes such as temperature and humidity and other changes over time. As a result, the position detection patterns are not correctly formed as desired. When the position detection patterns are not correctly formed, since the position detection patterns are not correctly detected, the color positional misalignment is not corrected in a precise manner.

In attempt to solve the above problem, another prior art such as disclosed in Japanese Patent Publications Hei 10-260567, Hei 7-181795 and 2002-14505 disclose a corrective method in which the position detection patterns are detected and the detected density results are compared to a predetermined range of values. If the detected density results are out of the predetermined range, the density-adjusted position detection patterns are again formed for an accurate correction in the color positional misalignment process. Unfortunately, the above prior art technique requires an additional amount of time at the detection for the color positional misalignment correction since the density is always determined for a density adjustment process during the color misalignment correction process.

SUMMARY OF THE INVENTION

In order to solve the above and other problems, according to a first aspect of the current invention, a method of correcting color positional misalignment among multiple color forming units in generating a color image, including the steps of forming a density pattern on a transfer belt, detecting the density pattern to determine a density level in the density pattern in advance of correcting color positional misalignment, and correcting the color positional misalignment utilizing the density level in the detecting step.

According to a second aspect of the current invention, a method of correcting color positional misalignment among multiple color forming units in generating a color image, including the steps of determining whether or not a density determination request exists for a density check, in response to the determining step, performing the density check including the steps of forming one of two predetermined density patterns on a transfer belt and detecting the density pattern to determine a density level in the density pattern in advance of correcting color positional misalignment, and correcting the color positional misalignment utilizing the density level in the detecting step.

According to a third aspect of the current invention, a computer program for correcting color positional misalignment among multiple color forming units in generating a color image, performing the tasks of forming a density pattern on a transfer belt, detecting the density pattern to determine a density level in the density pattern in advance of correcting color positional misalignment, and correcting the color positional misalignment utilizing the density level in the detecting step.

According to the fourth aspect of the current invention, a computer program for correcting color positional misalignment among multiple color forming units in generating a color image, performing the tasks of, determining whether or not a density determination request exists for a density check, in response to the determining task, performing the density check including the tasks of forming one of two predetermined density patterns on a transfer belt and detecting the density pattern to determine a density level in the density pattern in advance of correcting color positional misalignment, and correcting the color positional misalignment utilizing the density level in the detecting task.

According to the fifth aspect of the current invention, an apparatus for correcting color positional misalignment among multiple color forming units in generating a color image, including, a memory unit for storing information, image forming units for respectively forming the color image in a predetermined color in a successively overlapping manner, a position correcting controller connected to the memory for initiating a density check to determine a density level among the image forming units, the position correcting controller storing the density level in the memory, and a system controller connected to the position correcting controller and the image forming units for correcting the color positional misalignment utilizing the stored density level.

These and various other advantages and features of novelty which characterize the invention are pointed out with particularity in the claims annexed hereto and forming a part hereof. However, for a better understanding of the invention, its advantages, and the objects obtained by its use, reference should be made to the drawings which form a further part hereof, and to the accompanying descriptive matter, in which there is illustrated and described a preferred embodiment of the invention.

DETAILED DESCRIPTION OF THE PREFERRED EMBODIMENT(S)

Based upon incorporation by external reference, the current application incorporates all disclosures in the corresponding foreign priority document (Japanese Patent Applications 2003-298077 and 2003-326556) from which the current application claims priority.

Figure 1:
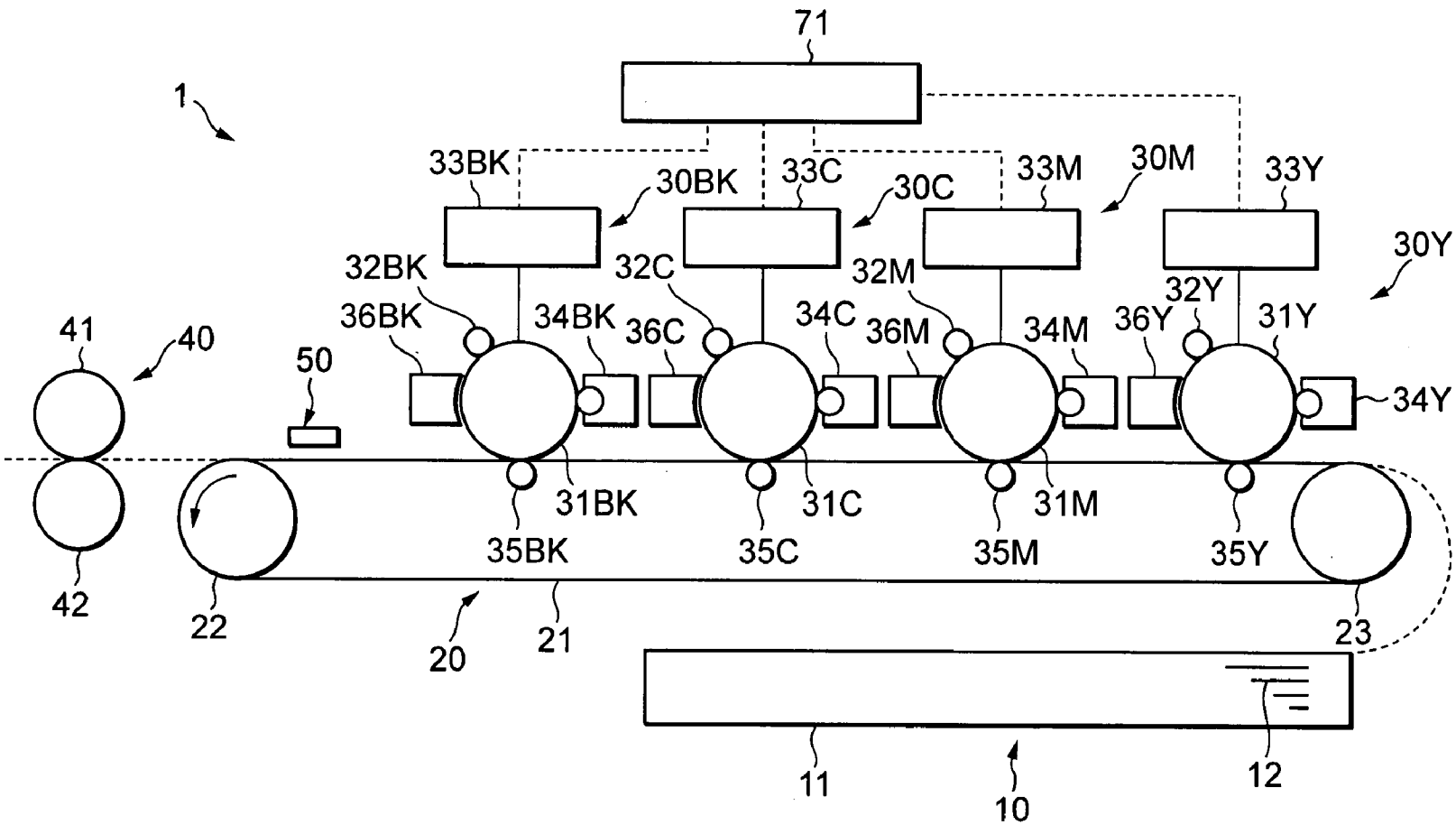
FIG. 1 is a diagram illustrating one preferred embodiment of a color image forming device according to the current invention.

Referring now to the drawings, wherein like reference numerals designate corresponding structures throughout the views, and referring in particular to FIG. 1, a diagram illustrates one preferred embodiment of a color image forming device 1 according to the current invention. In general, the color image forming device 1 includes a paper supply unit 10, a transfer belt unit 20, a yellow image forming unit 30Y, a magenta image forming unit 30M, a cyan image forming unit 30C and a black image forming unit 30BK, which are located along the transfer belt unit 20, a fixation unit 40 and an image position detecting unit 50. Although FIG. 1 does not show other components, the color image forming device 1 additionally includes a control unit for controlling various part of the color image forming device 1, certain motors and operational mechanisms for transferring the driving force from the motors to the motor-driven components.

Still referring to FIG. 1, further details of the units are provided below. The paper supply unit 10 separates one sheet of paper, image recording medium or image-transfer medium 12 from the supply cassette 11 via a supply roller and a separation material and outputs to a register roller, which adjust the timing of the outputted image-transfer medium 12 before transferring onto the transfer belt unit 20 at a predetermined timing. The supply roller, the separation material and the register roller are not shown in FIG. 1. The transfer belt unit 20 further includes a transfer belt 21 and operational rollers 22, 23, and the transfer belt 21 is supported for rotation by the operational rollers 22, 23. A system controller 71, which will be further described with respect to FIG. 5, controls a motor for rotating the operational roller 22 in the counter clockwise direction as indicated by an arrow. Thus, the transfer belt 21 successively transfers the image-transfer medium 12 from the paper supply unit 10 to the yellow image forming unit 30Y, the magenta image forming unit 30M, the cyan image forming unit 30C and the black image forming unit 30BK. The yellow image forming unit 30Y, the magenta image forming unit 30M, the cyan image forming unit 30C and the black image forming unit 30BK thus respectively form a yellow toner image, a magenta toner image, a cyan toner image and a black toner image on the image-transfer medium 12.

The yellow image forming unit 30Y, the magenta image forming unit 30M, the cyan image forming unit 30C and the black image forming unit 30BK each have the following components. A yellow photoreceptor drum 31Y, a magenta photoreceptor drum 31M, a cyan photoreceptor drum 31C and a black photoreceptor drum 31BK are located at a predetermined distance from each other along the transfer belt 12 in the transfer direction. Around the yellow photoreceptor drum 31Y, a charging unit 32Y, an exposing unit 33Y, a developing unit 34Y, a transfer unit 35Y, a cleaning unit 36Y and a discharging unit are located. Similarly, around the magenta photoreceptor drum 31M, a charging unit 32M, an exposing unit 33M, a developing unit 34M, a transfer unit 35M, a cleaning unit 36M and a discharging unit are located. Around the cyan photoreceptor drum 31C, a charging unit 32C, an exposing unit 33C, a developing unit 34C, a transfer unit 35C, a cleaning unit 36C and a discharging unit are located. Lastly, around the black photoreceptor drum 31BK, a charging unit 32BK, an exposing unit 33BK, a developing unit 34BK, a transfer unit 35BK, a cleaning unit 36BK and a discharging unit are located. The discharging unit is not illustrated in FIG. 1.

At each of the image forming units, 30Y, 30M, 30C and 30BK, the photoreceptor drums, 31Y, 31M, 31C and 31BK are rotated by a motor mechanism in the clockwise direction so as to uniformly charge the drum surface respectively by the charger units, 32Y, 32M, 32C and 32BK. A static image is separately formed on the photoreceptor drums, 31Y, 31M, 31C and 31BK by reflecting a modulated laser from the exposing units, 33Y, 33M, 33C and 33BK according to the image data. Based upon the formed static image on the photoreceptor drums, 31Y, 31M, 31C and 31BK, the yellow toner (Y), the magenta toner (M), the cyan toner (C) and the black toner (BK) are respectively applied to form a toner image on each of the photoreceptor drums, 31Y, 31M, 31C and 31BK. When the image recording sheet 12 is transferred on the transfer belt 21 beneath the photoreceptor drums, 31Y, 31M, 31C and 31BK, the transfer units, 35Y, 35M, 35C and 35BK located over the transfer belt 21 charge the transfer voltage so as to successively transfer a toner image in the yellow toner (Y), the magenta toner (M), the cyan toner (C) and the black toner (BK) respectively from the photoreceptor drums, 31Y, 31M, 31C and 31BK onto the recording sheet 12 in an overlapping manner. After the toner image transfer is completed, the cleaning unit 36 removes the residual toner from the photoreceptor drums, 31Y, 31M, 31C and 31BK, and the discharge unit removes the residual charge. Subsequently, the photoreceptor drums, 31Y, 31M, 31C and 31BK are charged respectively by the charger units, 32Y, 32M, 32C and 32BK for a next image forming operation.

As described above, the recording medium 12 with the image formed by the transfer of the yellow toner (Y), the magenta toner (M), the cyan toner (C) and the black toner (BK) is now further transferred by the transfer belt 21 while the recording medium 12 is statically attached to the transfer belt 21. Subsequently, the recording medium 12 is separated from the transfer belt 21 and transferred onto the fixation unit 40. The fixation unit 40 further includes a fixation roller 41, a pressure roller 42 and the output roller that is not illustrated in FIG. 1. The fixation roller 41 and the pressure roller 42 are pressed together at a predetermined pressure. As one of the fixation roller 41 and the pressure roller 42 is driven, the other roller follows. The fixation roller 41 is heated to a predetermined temperature by an internal heater. Upon transfer by the transfer belt 21, the fixation unit 40 heats and pressurizes the transferred recording medium 12 with the image formed by the transfer of the yellow toner (Y), the magenta toner (M), the cyan toner (C) and the black toner (BK). Consequently, the fixation roller 41 fixes each of the color toners (Y), (M), (C) and (BK) on the recording medium 12 and outputs the fixed recording medium 12 onto the output tray that is not shown in FIG. 1 via a pair of output rollers. A pattern detection unit or image position detection unit 50 is located between the fixation unit 40 and the black image forming unit 30BK over the transfer belt 20.

Figure 2:
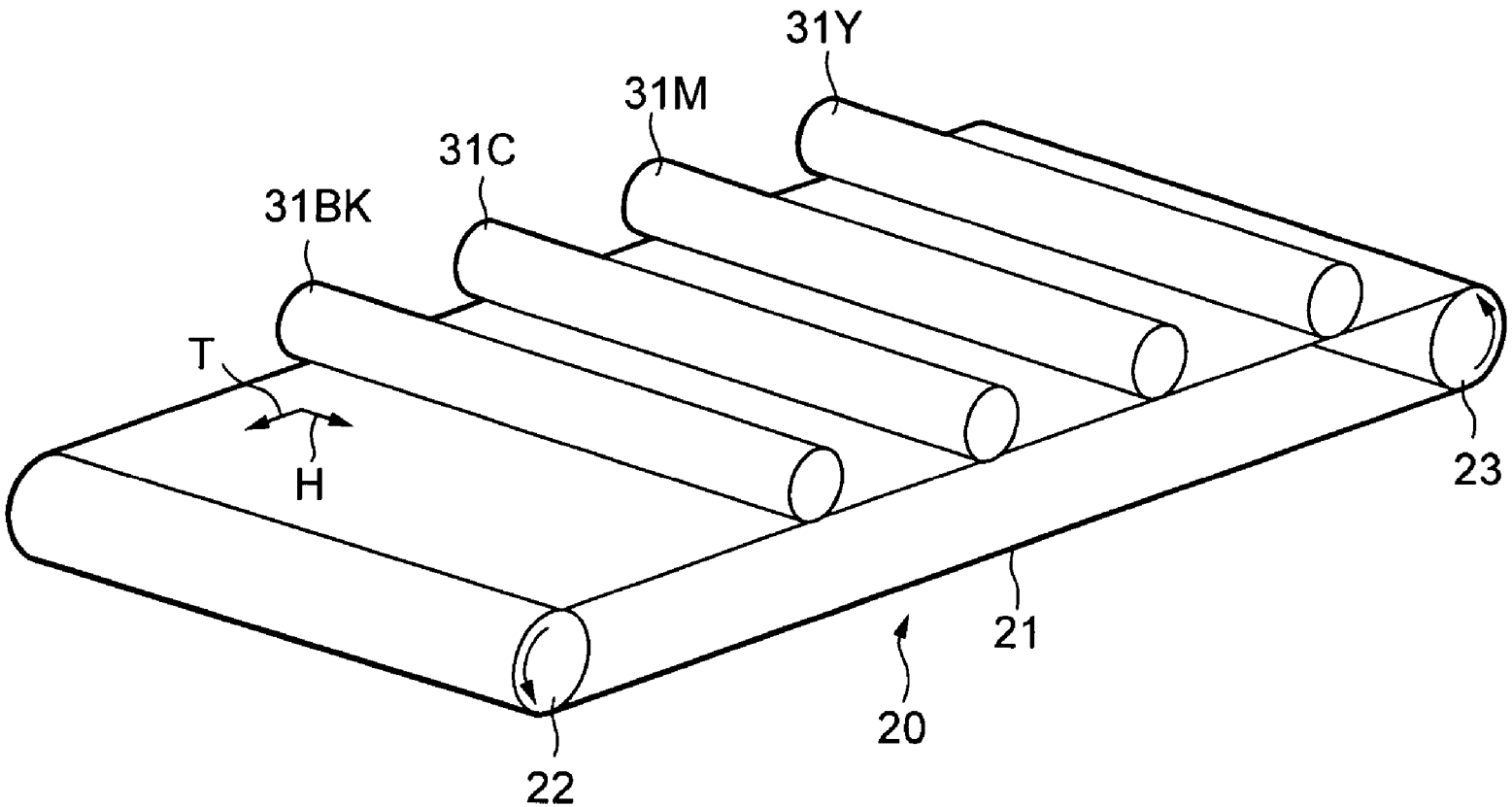
FIG. 2 is a diagram illustrating certain units of the color image forming device of FIG. 1 according to the current invention.

Now referring to FIG. 2, a diagram illustrates certain units of the color image forming device 1 of FIG. 1 according to the current invention. The yellow photoreceptor drum 31Y, the magenta photoreceptor drum 31M, the cyan photoreceptor drum 31C and the black photoreceptor drum 31BK are located at a predetermined distance from each other along the transfer belt 12 in a transfer direction or main-running direction T, which is parallel to the movement of the transfer belt 12 as caused by the counter clockwise rotation of the rollers 22, 23 as indicated by arrows. A sub-running direction H is perpendicular to the transfer direction or main-running direction T.

Figure 3:
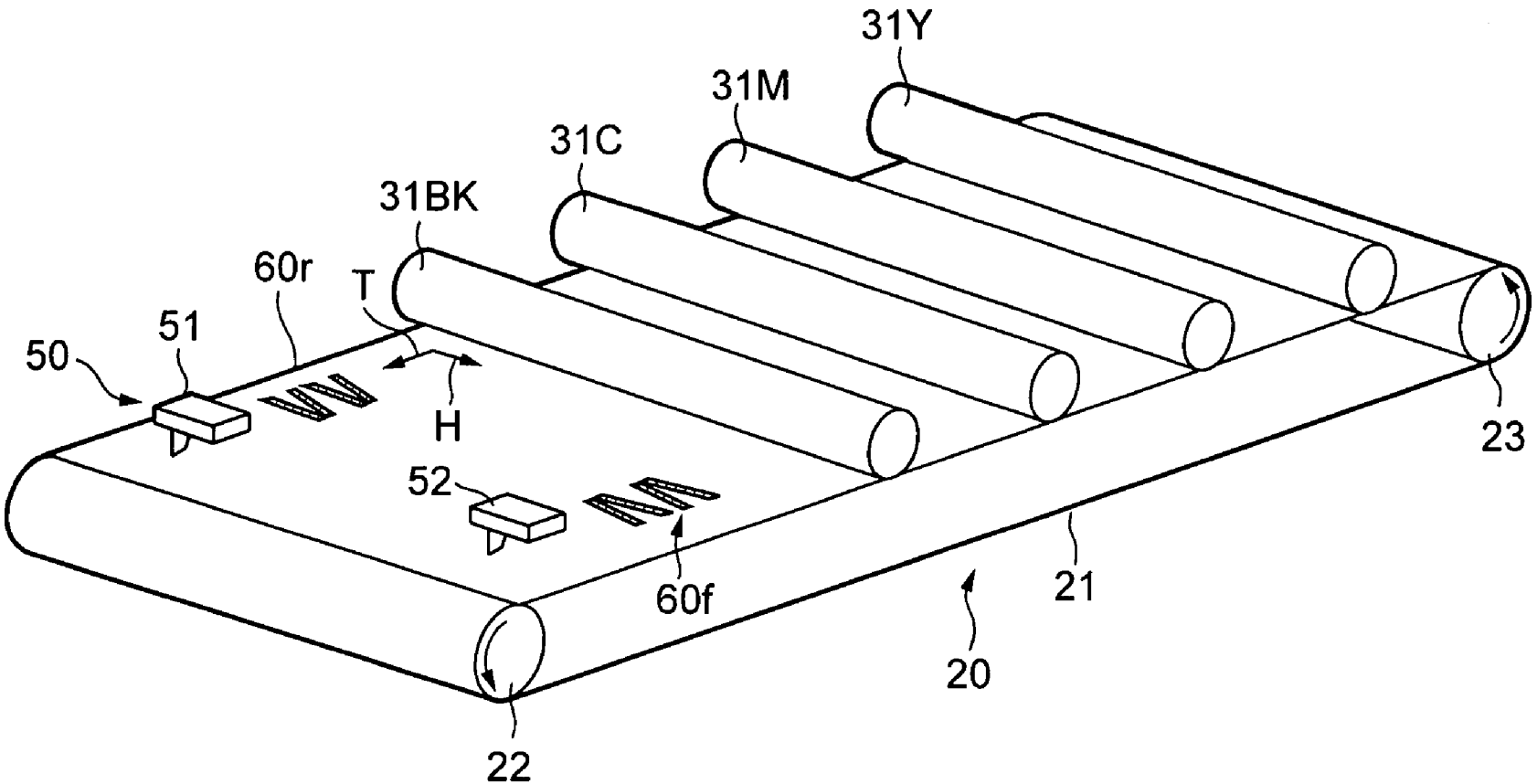
FIG. 3 is a diagram illustrating that the pattern detection unit or image position detection unit is located in the downstream of the black image forming unit in the transfer direction of the recording medium according to the current invention.

Now referring to FIG. 3, a diagram illustrates that the pattern detection unit or image position detection unit 50 is located in the downstream of the black image forming unit 30BK in the transfer direction T of the recording medium 12 according to the current invention. Most of the elements of FIG. 3 are substantially identical to those of FIG. 2. Since these substantially identical elements have been described with respect to FIG. 2, the description will not be reiterated here. The image position detection unit 50 further includes a pair of reflective optical sensors 51 and 52 that is aligned in the sub-running direction H. Although it is not diagrammatically shown, the reflective optical sensors 51 and 52 further internally include an optical emitting source and an optical receiving element. For example, a light emitting diode is used as the optical emitting source while a photo diode is used as the optical receiving element. In addition, position detection patterns or misaligned position detection patterns 60*f* and 60*r* are also formed near front and rear edges of the transfer belt 21 in the sub-running direction H. A plurality of sets of the position detection patterns 60*f* and 60*r* is provided. The optical sensors 51 and 52 receive the light that has been emitted from the light emitting source towards the position detection patterns 60*f* and 60*r* on the transfer belt 21 and has been reflected off the position detection patterns 60*f* and 60*r*.

Figure 4:
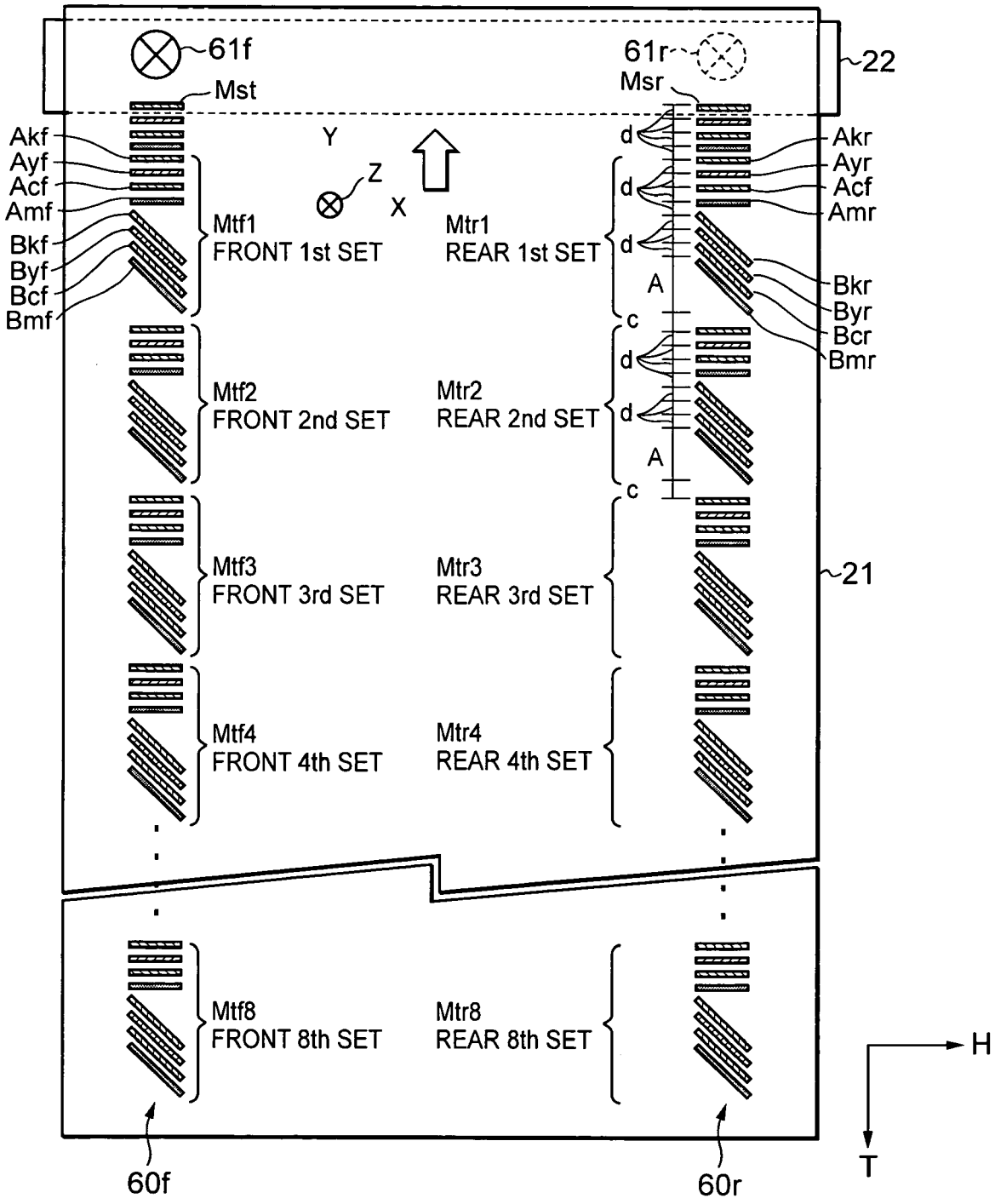
FIG. 4 is a diagram illustrating that the position detection patterns have multiple sets of patterns along the front and rear edges of the transfer belt 2 according to the current invention.

Now referring to FIG. 4, a diagram illustrates that the position detection patterns 60*f* and 60*r* have multiple sets of patterns along the front and rear edges of the transfer belt 21 according to the current invention. On the transfer belt 21 above the rollers 22, the position detection patterns 60*f* and 60*r* are respectively located near the front portion and the rear portion in the sub-running direction H of the transfer belt 21 as a beginning marker. As a part of the beginning markers, following black start markers, Mst and Msr, three markers are respectively located near the position detection patterns 60*f* and 60*r*. Two adjacent markers have a pitch d.

Following the set Mst, eight sets Mtf1 through Mtf8 of the detection patterns are located along the entire length of the front portion of the transfer belt 21. In each set of the eight sets Mtf1 through Mtf8, there are four position detection patterns Akf, Ayf, Acf and Amf that are parallel to the sub-running direction H for the four colors and four additional detection patterns Bkf, Byf, Bcf and Bmf that are at a predetermined angle with respect to the sub-running direction H for the four colors. For example, the predetermined angle is approximately 45 degrees. Similarly, following the set Msr, eight sets Mtr1 through Mtr8 of the detection patterns are located along the rear portion of the transfer belt 21. In each set of the eight sets Mtr1 through Mtr8, there are four position detection patterns Akr, Ayr, Acr and Amr that are parallel to the sub-running direction H for the four colors and four additional detection patterns Bkr, Byr, Bcr and Bmr that are at a predetermined angle with respect to the sub-running direction H for the four colors. For example, the predetermined angle with respect to the sub-running direction H is 45 degrees. The above patterns Akf, Ayf, Acf, Amf, Bkf, Byf, Bcf, Bmf, Akr, Ayr, Acr, Amr, Bkr, Byr, Bcr and Bmr are all positioned at a first predetermined interval d. Furthermore, the above sets Mtf1 through Mtf8 and Mtr1 through Mtr8 are all positioned at a second predetermined interval c. Within in one set, the pitch between markers is successively expressed by the following pitch expression, 7d+A+c. The eight set of marks and one starting mark Msr include sixty five markers, and the total length of these markers is approximately three quarters of the circumference of the photoreceptor drum.

Figure 5:
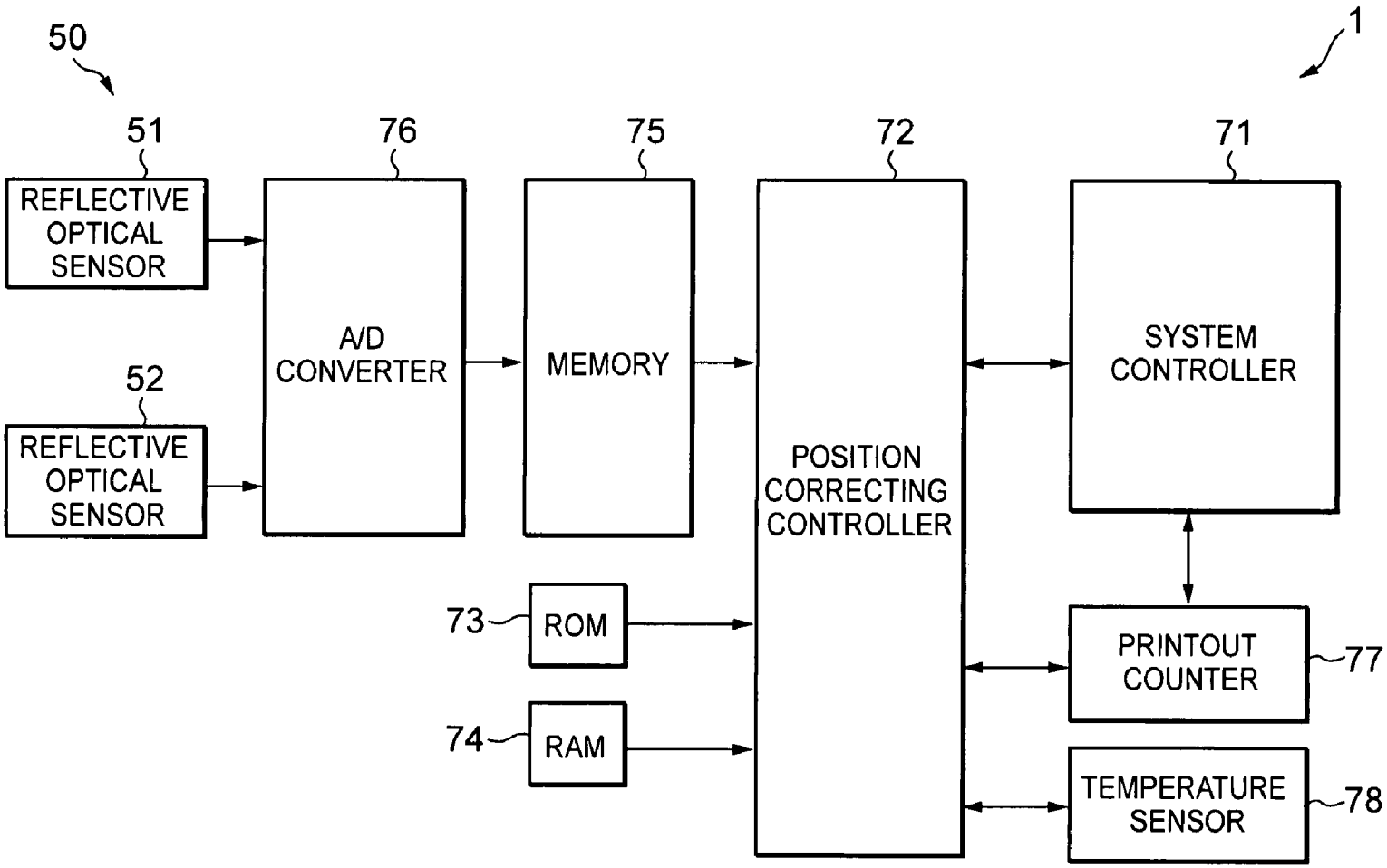
FIG. 5 is a diagram illustrating one preferred embodiment of the system for detecting an image position according to the current invention.

Now referring to FIG. 5, a diagram illustrates one preferred embodiment of the system for detecting an image position according to the current invention. The color image forming device 1 further includes a system controller 71, a position correcting controller 72, a read-only-memory (ROM) 73, a random-access-memory (RAM) 74, a memory 75, an analog-to-digital (A/D) converter 76, a print out counter 77 and a temperature sensor 78. The reflective optical sensors 51 and 52 of the image position detection unit 50 output an analog signal indicative of an amount of received light to the A/D converter 76. The A/D converter 76 converts an analog detection pattern signal from the reflective optical sensors 51 and 52 and outputs the converted position detection pattern signal to the memory 75 for storage. The ROM 73 stores system programs including a color position misalignment correction program for the color image forming device 1 and various data for executing the system program. The data includes necessary data for executing the color position correction program. The system controller 71 utilizes the RAM 73 as a work memory to temporarily store various data for the system program. Hereinafter, the color position correction or color misalignment correction is synonymous with the position correction as well as the color position misalignment correction.

Still referring to FIG. 5, the system controller 71 controls various parts of the color image forming device 1 to execute a sequence and to correct the misplaced position. The print out counter 77 counts a number of print outputs under the control of the system controller 71. That is, the system controller 71 increments a count value P of the print out counter 77 each time a sheet of the recording medium 12 is transferred from the paper supply unit 10. The temperature sensor 78 detects an internal temperature T in the color image forming device 1 and outputs the detected temperature T to the position correcting controller 72. The position correcting controller 72 monitors the detected temperature T from the temperature sensor 78 and the count value P from the print out counter 77 during the printing job. Based upon the above monitored inputs, the position correcting controller 72 issues a position correcting execution request to the system controller 71 upon satisfying predetermined correction execution conditions that have been stored in the ROM 73 or the RAM 74. In response to control signals such as a writing clock signal or a writing timing signal from the position correcting controller 72, the system controller 71 performs the correction process for each of the four colors by modifying the values of the writing clock signal and or the writing timing signal. Furthermore, before the system controller 71 is performing the correction process, the system controller 71 interrupts a printing process and issues the position correcting controller 72 an execution permission to initiate the position correcting process.

After receiving the execution permission, the position correcting controller 72 determines a tilted amount, a main-running misregister amount, a main-running miss-magnification amount, a sub-running misregister amount and a correction amount based upon the position detection pattern signal stored in the memory 75. The position correcting controller 72 transmits the system controller 71 the value of the control signals such as the writing clock signal and the writing timing signal for the exposing units, 33Y, 33M, 33C and 33BK in the image forming units, 30Y, 30M, 30C and 30BK. The system controller 71 performs the position correction for each color by modifying the timing according to the order sent from the position correcting controller 72. The color image forming device 1 performs the correction process for detecting the misalignment of the colors and correcting the color position in response to the detected temperature T from the temperature sensor 78 and the count value P from the print out counter 77. The color image forming device 1 also determines the image forming conditions for the position detection patterns 60*f* and 60*r* according to the detection results of a non-image density or darkness pattern 80, which will be further described with respect to FIG. 6. That is, the color image forming device 1 forms an image in each of the four colors on the image recording medium 12 in a successive manner at the image forming units, 30Y, 30M, 30C and 30BK. During this process, if each of the four color images is not positionally matched or aligned in the main-running direction, the sub-running direction, the scaling or the tilted angle, the color misalignment occurs and the image quality substantially decreases. For this reason, the color image forming device 1 monitors the detected temperature T from the temperature sensor 78 and the count value P from the print out counter 77 to initiate the color positional misalignment correction process. When the color misalignment correction execution conditions in the RAM 74 or ROM 73 are met, the color image forming device 1 performs the color misalignment correction process.

Figure 6:
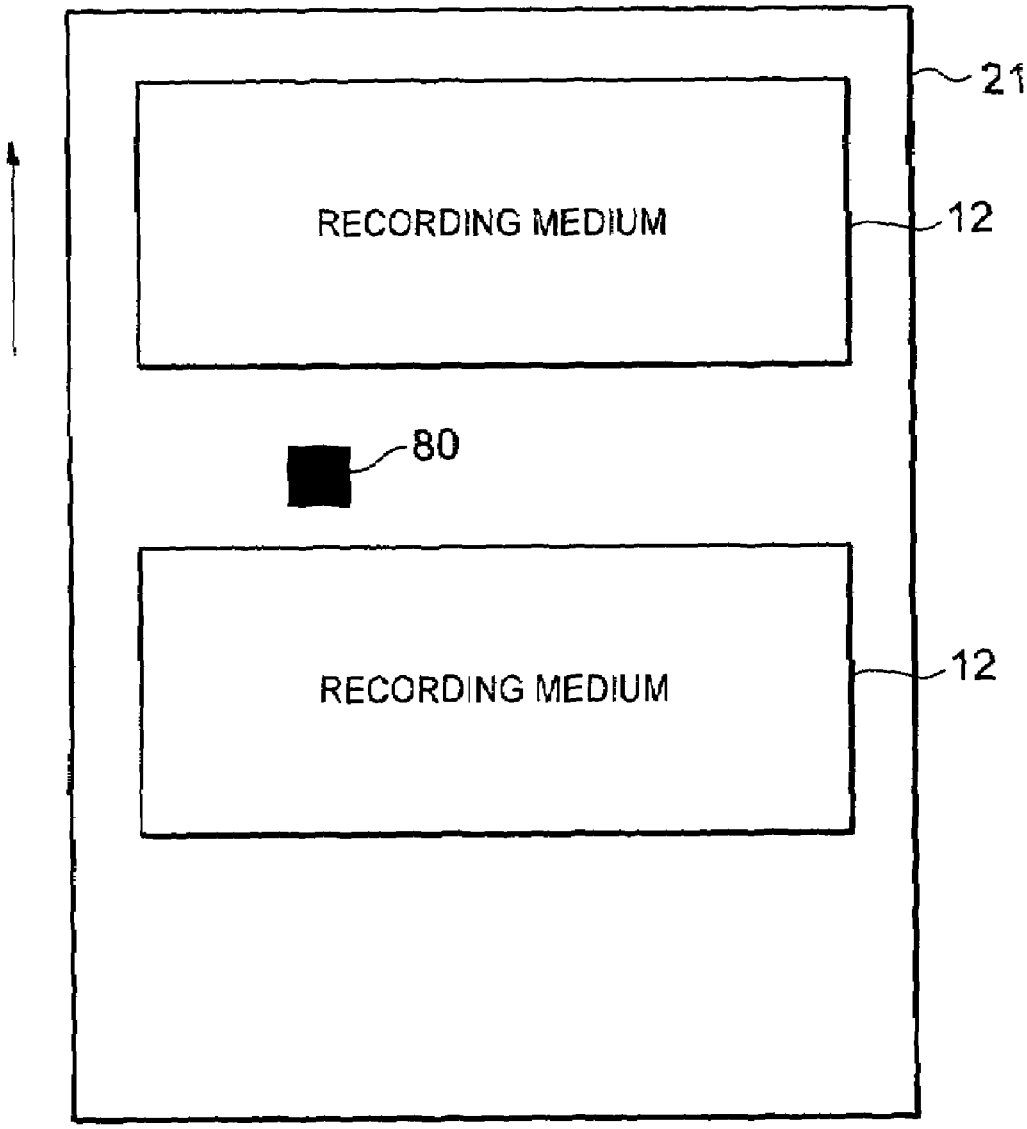
FIG. 6 is a diagram illustrating positional relationship among adjacent two of the image recording media and a marker as practiced in the current invention.

Now referring to FIG. 6, a diagram illustrates positional relationship among adjacent two of the image recording media and a marker as practiced in the current invention. Two adjacent image recording media 12 are placed on the transfer belt 21, which transfers them in the main-running direction as indicated by an arrow. Between the two adjacent image recording media 12, the non-image density pattern 80 is additionally formed at a certain distance from the two adjacent image recording media 12 to indicate an area outside the image forming area during a normal print process. The reflective optical sensors 51 and 52 of the color image forming device 1 detect the non-image density pattern 80 also during the normal print process. Thus, the reflective optical sensors 51 and 52 also function as a non-image detector. During the normal print process, the non-image density patterns 80 are detected in advance of the color positional misalignment correction. Because of the advance detection, the non-image density patterns 80 are also sometimes referred to as prior non-image density patterns.

Figure 7:
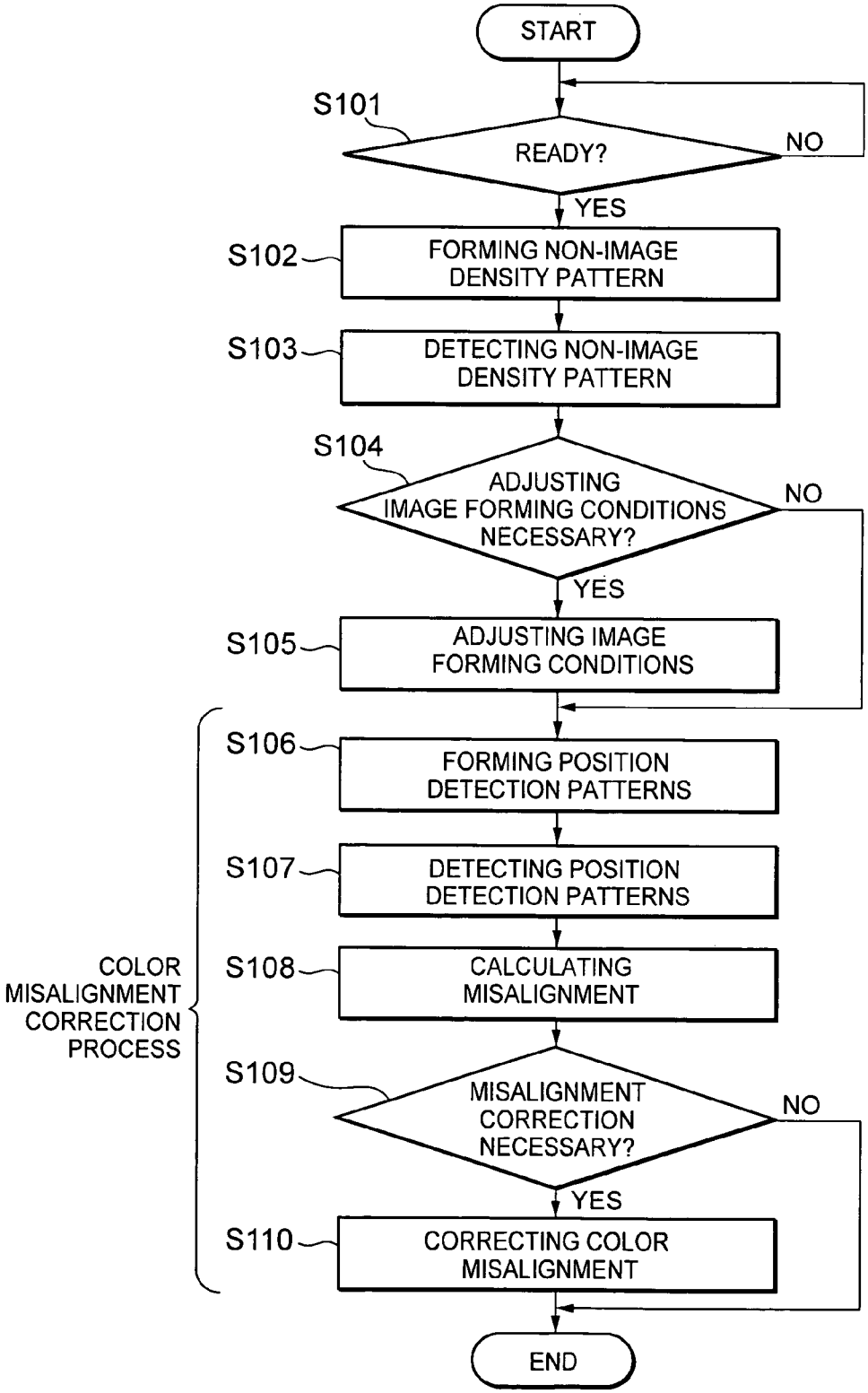
FIG. 7 is a flow chart illustrating steps involved in a first preferred process of correcting the color misalignment according to the current invention.

Referring to FIG. 7, a flow chart illustrates steps involved in a preferred process of correcting the color misalignment according to the current invention. In general, after the system controller 71 receives the execution permission to initiate the position correcting process from the position correcting controller 72, the color image forming device 1 performs the color misalignment correction process. In further detail, it is determined whether or not the execution permission has been received in a step S101. If no permission has been given, the preferred process waits at the step S101. On the other hand, if the permission has been given, the non-image density pattern 80 is formed in a step S102 and subsequently detected in a step S103. The color image forming device 1 converts the detected value from the reflective optical sensors 51 and 52 into a digital value at the A/D converter 76 and stores the converted digital value in the memory 75. The position correcting controller 72 transmits the system controller 71 the stored digital value as a non-image density pattern value D also in the step S103.

The system controller 71 determines whether or not it is necessary to calculate the image forming conditions for forming the position detection patterns 60*f* and 60*r* based upon the non-image density pattern value D in a step S104. For example, the system controller 71 compares the received non-image density pattern value D to a predetermined threshold value Dt in the RAM 74 in order to determine the necessity for the calculation of the image forming conditions in the step S104. If the received non-image density pattern value D exceeds a predetermined threshold value Dt, it is determined in the step S104 that the condition calculation is necessary to form the position detection patterns 60*f* and 60*r* in a step S105. In case of the condition calculation, according to the received non-image density pattern value D, the system controller 71 determines appropriate operational conditions such as a charge bias value, a developing bias value, a transfer bias value and the writing light amount in the step S105 before performing the color misalignment correction process. On the other hand, if it is determined in the step S104 that the condition calculation is not necessary, the preferred process skips the step S105. That is, the system controller 71 controls the image forming units, 30Y, 30M, 30C and 30BK without altering the operational conditions in the step S105, forms the position detection patterns 60*f* and 60*r* and executes the correction of the color misalignment before terminating the preferred process.

Still referring to FIG. 7, the following tasks are performed in association with the color misalignment correction process. After completing the write at the first station or the image forming unit 30Y, the system controller 71 forms the position detection patterns 60*f* and 60*r* at the both edges of the main-running direction of the transfer belt 21 as shown in FIGS. 3 and 4 by controlling each of the image forming units, 30Y, 30M, 30C and 30BK in a S106. When the transfer belt 21 transfers the formed position detection patterns 60*f* and 60*r* near the reflective optical sensors 51 and 52, in a step S107, the reflective optical sensors 51 and 52 detect these patterns 60*f* and 60*r* by sensing a change in sampled signals as will be described with respect to FIGS. 8A and 8B. The color image forming device 1 converts the detection signals from the reflective optical sensors 51 and 52 into a digital signal at the A/D converter 76 and stores the converted digital signals at the memory 75 also in the step S107. Subsequently, the position correcting controller 72 reads from the memory 75 the stored digital signals that have been detected by the reflective optical sensors 51 and 52 and determines the positional misalignment amount in a step S108. The position correcting controller 72 compares the above determined positional misalignment amount to a standard positional misalignment amount in the ROM 73 or the RAM 74 in a step S 109. If the above determined positional misalignment amount is within a predetermined amount range from the standard positional misalignment amount, the position correcting controller 72 reports to the system controller 71 that no color misalignment correction process is necessary. The preferred process terminates, and the system controller 71 performs the print job.

On the other hand, the above determined positional misalignment amount is not within a predetermined amount range from the standard positional misalignment amount, the position correcting controller 72 determines a skew misalignment amount, a main running-directional register misalignment amount, a sub running-directional register misalignment amount, a main running-directional scaling misalignment amount and a correctional amount in a step S110. In response to the above determined correctional amount, the position correcting controller 72 outputs the system controller 71 the corresponding control signal values such as a writing clock signal value and a writing timing signal value for the exposing units, 33Y, 33M, 33C and 33BK in the image forming units, 30Y, 30M, 30C and 30BK. In response to the writing clock signal value and the writing timing signal value from the position correcting controller 72, the system controller 71 performs the position correction for each color by modifying an original writing clock signal value and an original writing timing signal value of the image forming units, 30Y, 30M, 30C and 30BK in the step S110.

As described above, in summary, the color image forming device 1 according to the current invention forms a color image by successively transferring different color toner onto the image-transferring paper on the transfer belt 21 at the image forming units, 30Y, 30M, 30C and 30BK. At the image forming units, 30Y, 30M, 30C and 30BK, the color image forming device 1 also forms the positional detection patterns 60*f* and 60*r* on the transfer belt 21 for detecting the positional misalignment among the image forming units, 30Y, 30M, 30C and 30BK in forming a color image. At the reflective optical sensors 51 and 52 of the image position detecting unit 50, the color image forming device 1 detects the positional detection patterns 60*f* and 60*r*. Prior to performing the positional misalignment correction process based upon the detection results from the reflective optical sensors 51 and 52, the color image forming device 1 forms the non-image density pattern 80 on a non-image portion of the transfer belt 21 during a non-image formation period. The reflective optical sensors 51 and 52 detect the non-image density pattern 80. Consequently, the color image forming device 1 determines the image forming conditions to be used for forming the positional detection patterns 60*f* and 60*r* by the image forming units, 30Y, 30M, 30C and 30BK during the positional misalignment correction process. Since an image density is not detected or adjusted during the positional misalignment correction process, the, positional detection patterns 60*f* and 60*r* are generated in good quality in a shorter period of time. Thus, the appropriate positional misalignment process is performed while the processing efficiency, the image quality and the utilization efficiency all improve. In the above described preferred embodiment, the color image forming device 1 utilizes the reflective optical sensors 51 and 52 as a part of the image position detecting unit 50. In an alternative embodiment, other types of sensors such as a transparent optical sensor are used as a part of the image position detecting unit 50.

Figure 8A:
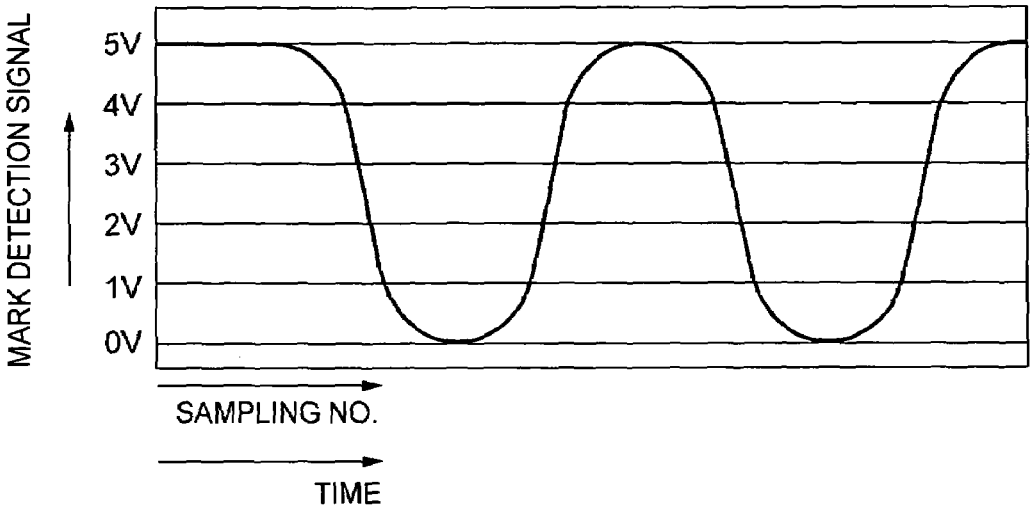
FIGS. 8A and 8B are graphs illustrating exemplary sampled signals at the reflective optical sensors according to the current invention.
Figure 8B:
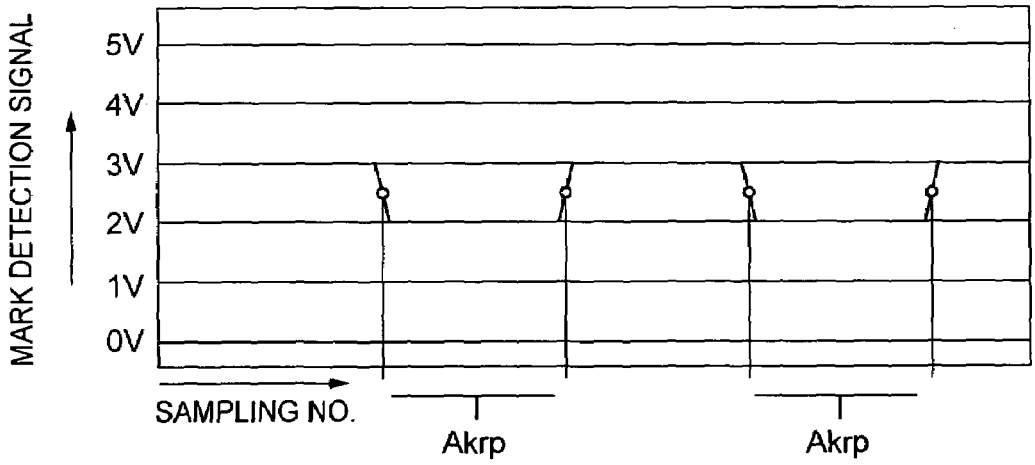

Now referring to FIGS. 8A and 8B, graphs illustrate exemplary sampled signals at the reflective optical sensors 51 and 52 according to the current invention. The Y axis indicates a detected sample signal value in volts while the x axis indicates time or sampling position. FIG. 8A shows that the reflective optical sensors 51 and 52 output an output voltage at approximately 5 volts when they detect no pattern on the transfer belt 21. FIG. 8A also shows that the reflective optical sensors 51 and 52 output an output voltage at approximately 0 volt when they detect the toner marks or the position detection patterns 60*f* and 60*r* on the transfer belt 21. FIG. 8B shows that the mark position is detected during an interval Akrd as indicated by a corresponding pair of vertical lines when the reflective optical sensors 51 and 52 detect the toner marks or the position detection patterns 60*f* and 60*r* on the transfer belt 21. The interval Akrd is determined based upon two corresponding downward and upward swings at approximately 2.5 volts.

Figure 9:
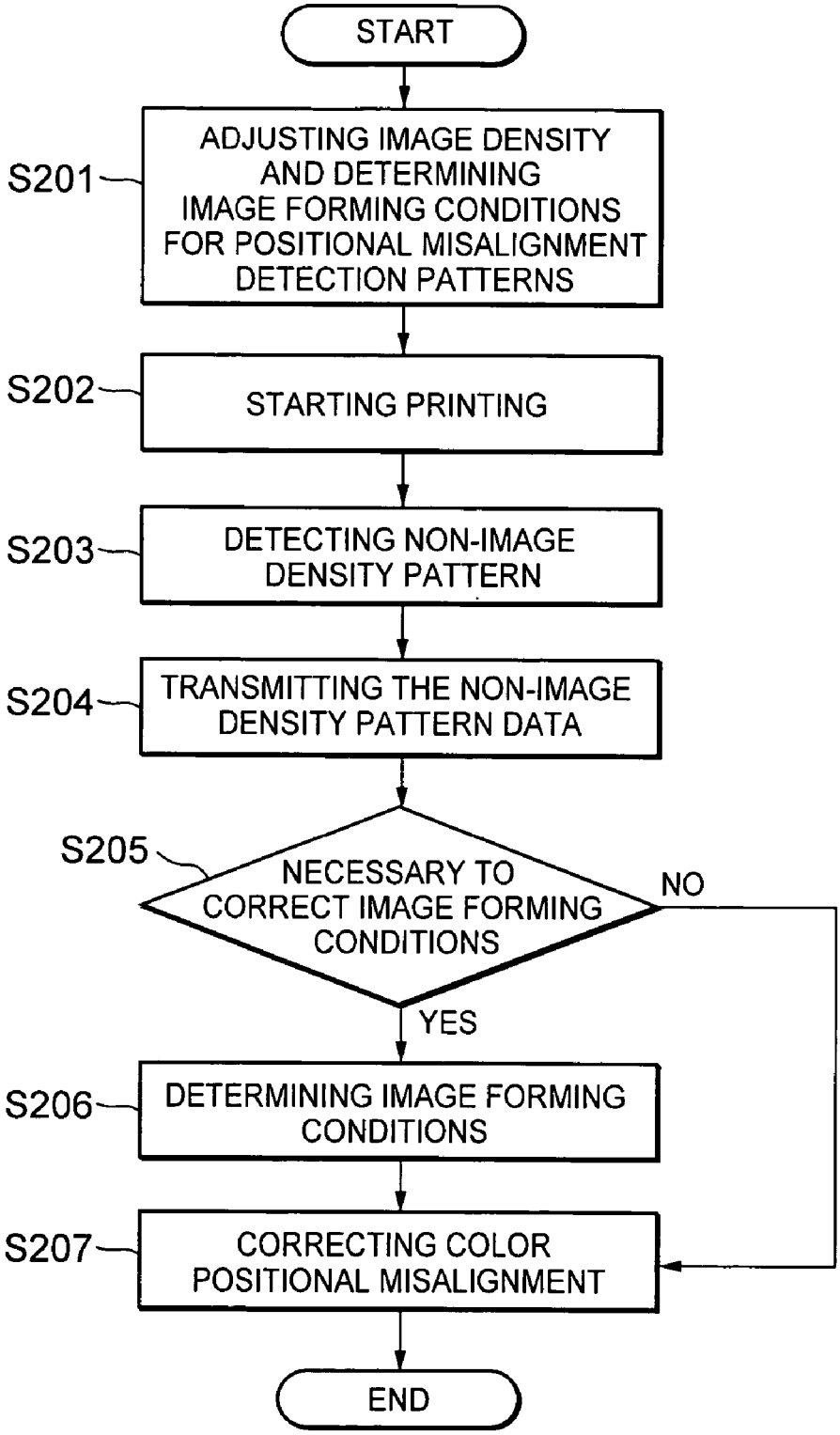
FIG. 9 is a flow chart illustrating steps involved in a second preferred process of correcting the color misalignment according to the current invention.

Referring to FIG. 9, a flow chart illustrates steps involved in a second preferred process of correcting the color misalignment according to the current invention.

The second preferred process is implemented by a second preferred embodiment of the color image forming device 1 according to the current invention. The substantially identical units or components are referred to by the same reference numbers between the first and second preferred embodiments. In general, the color image forming device 1 determines the image forming conditions for forming the position detection patterns 60*f* and 60*r* at the time of executing an image density adjustment process. At the time of printing, the color image forming device 1 corrects the image forming conditions for forming the position detection patterns 60*f* and 60*r* for the positional misalignment correction based upon the detected non-image density value D of the non-image density pattern 80. At the execution time of the positional misalignment correction, the positional misalignment is appropriately corrected by forming suitable ones of the position detection patterns 60*f* and 60*r* without performing the image density adjustment. That is, after the color image forming device 1 executes the image density adjustment process, the system controller 71 determines the image forming conditions for forming the position detection patterns 60*f* and 60*r* and stores the above determined image forming conditions in the RAM 74 in a step S201. The image forming conditions at the print time have been determined at the same time as the image forming conditions for the position detection patterns 60*f* and 60*r* for detecting the positional misalignment at the positional misalignment correction time. Furthermore, as the color image forming device 1 starts printing in a step S202, the color image forming device 1 forms the non-image density pattern 80 in the non-image area as shown in FIG. 6.

The system controller 71 initiates the positional misalignment correction process upon receiving a permission report from the position correcting controller 72. To start the correction process, the reflective optical sensors 51 and 52 detects the non-image density pattern 80 in a step S203. The color image forming device 1 converts the detected signal from the reflective optical sensors 51 and 52 into a digital signal at the A/D converter 76 and temporarily stores it in the memory 75. The color image forming device 1 subsequently transmits the stored digital signal from the position correcting controller 72 to the system controller 71 as the non-image density pattern detected value D in a step S204. Based upon the received non-image density pattern value D, the system controller 71 determines whether or not it is necessary to correct the image forming conditions for forming the position detection patterns 60*f* and 60*r* in a step S205. If it is determined in the step S205 that it is necessary to correct the image forming conditions, the image forming conditions that have been determined in the step S201 are adjusted according to the non-image density pattern detected value D in order to determine revised image forming conditions for forming the position detection patterns 60*f* and 60*r* in a step S206. The color image forming device 1 performs the positional misalignment correction time in a step S207. On the other hand, if it is determined in the step S205 that it is not necessary to correct the image forming conditions, the color image forming device 1 performs the positional misalignment correction time in the step S207 without revising the image forming conditions. The system controller 71 forms the position detection patterns 60*f* and 60*r* and corrects the color positional misalignment based upon the detection of the position detection patterns 60*f* and 60*r*.

As described above, the color image forming device 1 determines the image forming conditions in the step S201 prior to a normal printing step S202 for forming the position detection patterns 60*f* and 60*r* at the image density adjustment time by the image forming units, 30Y, 30M, 30C and 30BK. Subsequently, the color image forming device 1 forms the position detection patterns 60*f* and 60*r* under the above determined conditions at the color positional misalignment correction time and corrects the color positional misalignment based upon the detected non-image density pattern 80 in the step S203. Since an image density is not adjusted during the positional misalignment correction process, the positional detection patterns 60*f* and 60*r* are generated in good quality in a shorter period of time. Thus, the appropriate positional misalignment process is performed while the processing efficiency, the image quality and the utilization efficiency all improve.

Figure 10:
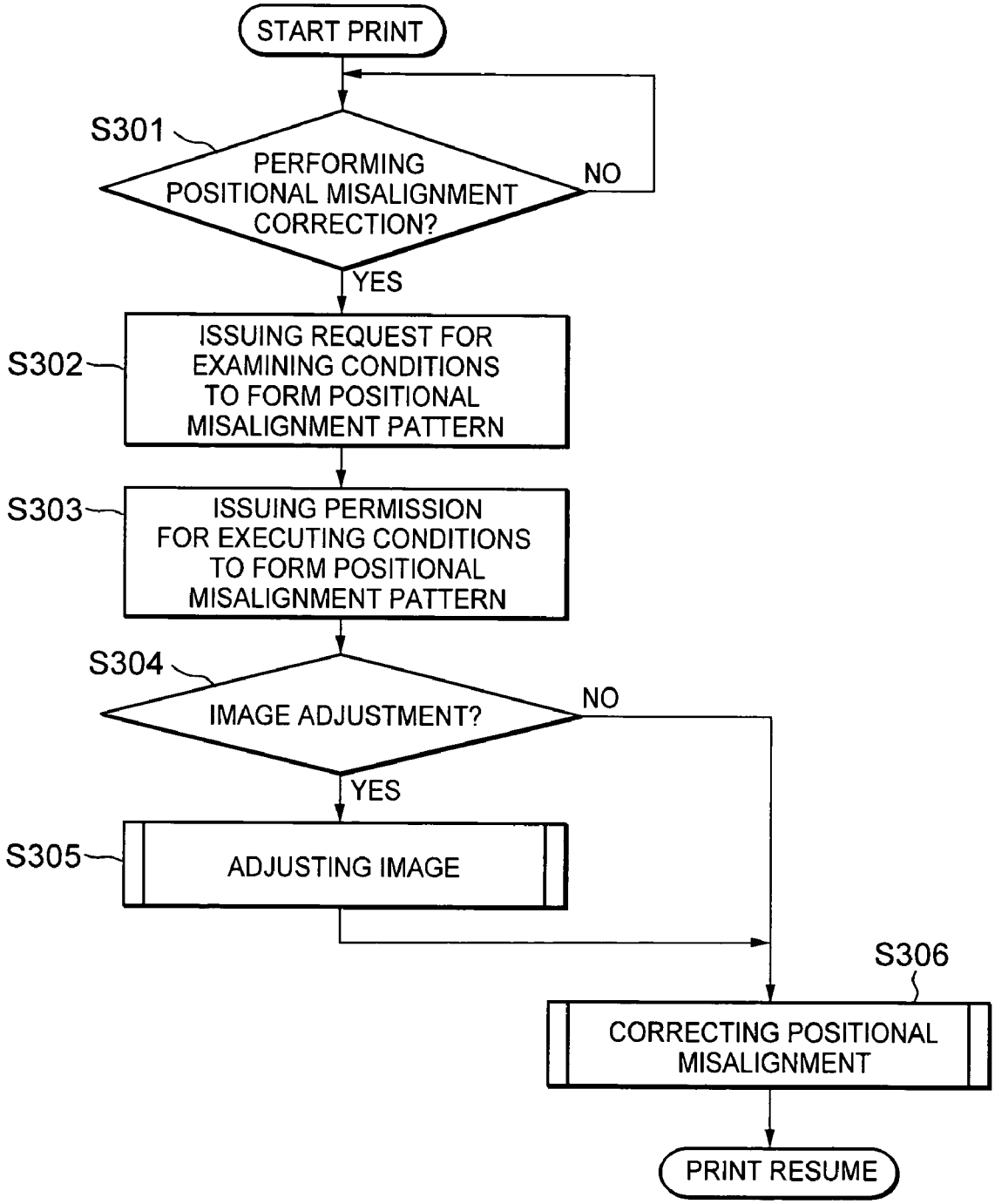
FIG. 10 is a flow chart illustrating steps involved in a third preferred process of correcting the color misalignment according to the current invention.

Referring to FIG. 10, a flow chart illustrates steps involved in a third preferred process of correcting the color misalignment according to the current invention. The third preferred process is implemented by a third preferred embodiment of the color image forming device 1 according to the current invention. The substantially identical units or components are referred to by the same reference numbers between the first and third preferred embodiments. In general, the color image forming device 1 determines at the printing time a need for the image density adjustment process based upon the non-image density pattern 80 and forms the positional detection patterns 60*f* and 60*r* for the color positional misalignment correction. In detail, it is determined in a step S301 whether or not it is a time to execute the color positional misalignment correction. The position correcting controller 72 monitors the timing for executing the color positional misalignment correction. For example, the position correcting controller 72 monitors at the print time the detected temperature T from the temperature sensor 78 and the count value P from the print out counter 77. The position correcting controller 72 compares the above monitored values against the color position misalignment conditions stored in the ROM 73 or the RAM 74 to determine whether or not it is a time to execute the color positional misalignment correction. If it is determined in the step S301 that it is not a time to execute the color positional misalignment correction, the preferred process repeats the step S301.

On the other hand, if it is determined in the step S301 that it is a time to execute the color positional misalignment correction, the position correcting controller 72 issues a pattern image forming condition execution request to the system controller 71 in a step S302. In a step S303, the system controller 71 interrupts the print process and issues a pattern image forming condition execution permission to the position correcting controller 72. Upon receiving the pattern image forming condition execution permission, the position correcting controller 72 determines in a step S304 whether or not it is necessary to perform the image density adjustment. That is, the color image forming device 1 detects at the reflective optical sensors 51 and 52 the non-image density pattern 80 that has been formed in the non-image forming area during the non-printing process. The color image forming device 1 converts the detected signal from the reflective optical sensors 51 and 52 into a digital signal at the A/D converter 76 and temporarily stores it in the memory 75. The color image forming device 1 subsequently transmits the stored digital signal from the position correcting controller 72 to the system controller 71 as the non-image density pattern detected value D in a step S303.

Based upon the received non-image density pattern value D, the system controller 71 determines whether or not it is necessary to correct the image forming conditions for forming the position detection patterns 60*f* and 60*r* in a step S304. If it is determined in the step S304 that it is necessary to correct the image forming conditions, the image density adjustment process is performed in a step S305. The color image forming device 1 performs the positional misalignment correction time in a step S306. As described above, the color image forming device 1 forms the position detection patterns 60*f* and 60*r* on both edges of the transfer belt 21 after performing the image density adjustment process by controlling the image forming units, 30Y, 30M, 30C and 30BK as shown in FIGS. 3 and 4. When the position detection patterns 60*f* and 60*r* are transferred to the image position detection unit 50, the reflective optical sensors 51 and 52 detects the position detection patterns 60*f* and 60*r* to perform the color positional misalignment correction in the step S306. On the other hand, if it is determined in the step S304 that it is not necessary to correct the image forming conditions, the color image forming device 1 forms the position detection patterns 60*f* and 60*r* on both edges of the transfer belt 21 without performing the image density adjustment process by controlling the image forming units, 30Y, 30M, 30C and 30BK as shown in FIGS. 3 and 4. When the position detection patterns 60*f* and 60*r* are transferred to the image position detection unit 50, the reflective optical sensors 51 and 52 detects the position detection patterns 60*f* and 60*r* to perform the color positional misalignment correction in the step S306. The system controller 71 resumes the interrupted print job upon completing the color positional correction process.

As described above, the color image forming device 1 forms a color image by successively transferring a different color onto the transfer paper on the transfer belt 21 at the image forming units, 30Y, 30M, 30C and 30BK. At the same time, the color image forming device 1 forms on the transfer belt 21 a positional misalignment detection pattern indicative of the positional misalignment at the image forming units, 30Y, 30M, 30C and 30BK. The color image forming device 1 detects the positional misalignment detection pattern at the reflective optical sensors 51 and 52. Before the positional correction is performed based upon the detected positional misalignment results, the image forming device 1 forms in a non-image area of the transfer belt 21 the non-image density pattern 80 and detects the formed non-image density pattern 80 at the reflective optical sensors 51 and 52. It is then determined whether or not to perform the density adjustment process for forming the position detection patterns 60*f* and 60*r* at the image forming units, 30Y, 30M, 30C and 30BK based upon the detected data from the reflective optical sensors 51 and 52s. Thus, without performing an unnecessary density adjustment process, the position detection patterns 60*f* and 60*r* are formed well, and the positional misalignment correction process is shortened. In addition, the appropriate positional misalignment process is performed while the processing efficiency, the image quality and the utilization efficiency all improve.

Figure 11:
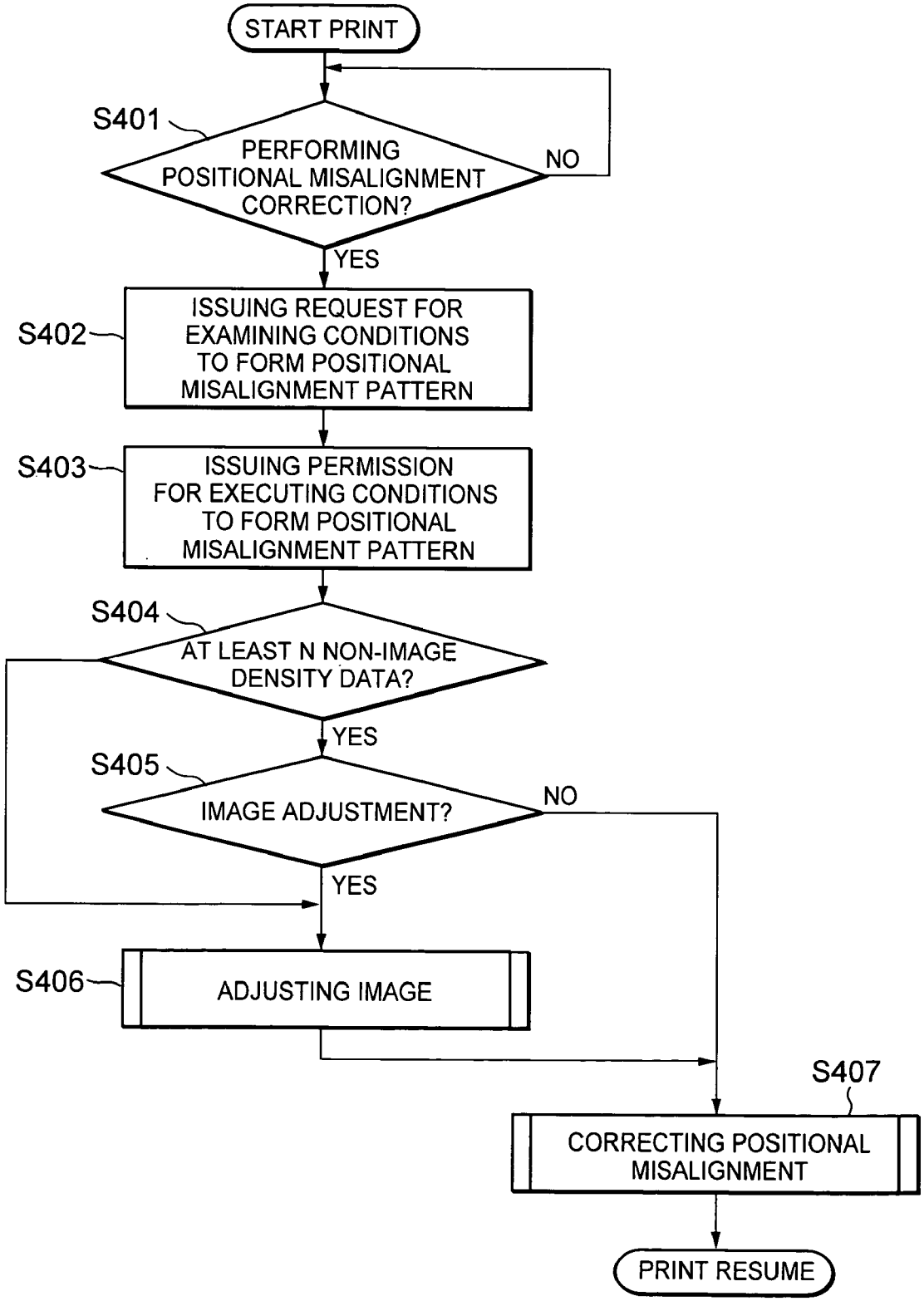
FIG. 11 is a flow chart illustrating steps involved in a fourth preferred process of correcting the color misalignment according to the current invention.

Now referring to FIG. 11, a flow chart illustrates steps involved in a fourth preferred process of correcting the color misalignment according to the current invention. The fourth preferred process is implemented by a fourth preferred embodiment of the color image forming device 1 according to the current invention. The substantially identical units or components are referred to by the same reference numbers between the first and fourth preferred embodiments. In general, the color image forming device 1 determines the necessity for the image density adjustment process based upon the detection value D of the non-image density pattern 80 that is above a predetermined value and forms the position detection patterns 60*f* and 60*r* to perform the positional misalignment correction. That is, the color image forming device 1 always monitors whether or not it is a time for performing the color positional misalignment correction process at the position correcting controller 72 in a step S401. For example, the position correcting controller 72 monitors at the print time the detected temperature T from the temperature sensor 78 and the count value P from the print out counter 77. The position correcting controller 72 compares the above monitored values against the color position misalignment conditions stored in the ROM 73 or the RAM 74 to determine whether or not it is a time to execute the color positional misalignment correction. If it is determined in the step S401 that it is not a time to execute the color positional misalignment correction, the preferred process repeats the step S401. On the other hand, if it is determined in the step S401 that it is a time to execute the color positional misalignment correction, the position correcting controller 72 issues a pattern image forming condition execution request to the system controller 71 in a step S402. In a step S403, the system controller 71 interrupts the print process and issues a pattern image forming condition execution permission to the position correcting controller 72.

Upon receiving the pattern image forming condition execution permission, the position correcting controller 72 determines in a step S404 whether or not the detected non-image density pattern value D exceeds a predetermined value N. If it is determined in the step S404 that a number of the detected non-image density pattern values D exceeds the predetermined value N, it is further determined in a step S405 whether or not it is necessary to perform the image density adjustment. That is, the color image forming device 1 detects at the reflective optical sensors 51 and 52 the non-image density pattern 80 that has been formed in the non-image forming area during the non-printing process. The color image forming device 1 converts the detected signal from the reflective optical sensors 51 and 52 into a digital signal at the A/D converter 76 and temporarily stores it in the memory 75. The position correcting controller 72 subsequently compares a number of the stored digital signals as the non-image density pattern detected value D to the predetermined value N. The position correcting controller 72 determines whether or not it is necessary to perform the density adjustment process for forming the position detection patterns 60*f* and 60*r* in the step S405. If it is determined in the step S405 that it is necessary to perform the density adjustment process, the image density adjustment process is performed in a step S406.

The color image forming device 1 performs the positional misalignment correction time in a step S407. As described above, the color image forming device I forms the position detection patterns 60*f* and 60*r* on both edges of the transfer belt 21 after performing the image density adjustment process by controlling the image forming units, 30Y, 30M, 30C and 30BK as shown in FIGS. 3 and 4. When the position detection patterns 60*f* and 60*r* are transferred to the image position detection unit 50, the reflective optical sensors 51 and 52 detects the position detection patterns 60*f* and 60*r* for determining a misalignment amount to perform the color positional misalignment correction in the step S407. On the other hand, if it is determined in the step S404 that the number of the detected non-image density pattern values D fails to exceed the predetermined value N, the step S405 is skipped to perform the image adjustment process in the step S406 and the color positional misalignment-correction process in a step S407.

In the step S407, the color image forming device 1 forms the position detection patterns 60*f* and 60*r* on both edges of the transfer belt 21 without performing the image density adjustment process by controlling the image forming units, 30Y, 30M, 30C and 30BK as shown in FIGS. 3 and 4. When the position detection patterns 60*f* and 60*r* are transferred to the image position detection unit 50, the reflective optical sensors 51 and 52 detects the position detection patterns 60*f* and 60*r* for determining a misalignment amount to perform the color positional misalignment correction in the step S407. Furthermore, if it is determined in the step S405 that it is not necessary to perform the image adjustment process, the color image forming device 1 forms the position detection patterns 60*f* and 60*r* on both edges of the transfer belt 21 without performing the image density adjustment process by controlling the image forming units, 30Y, 30M, 30C and 30BK as shown in FIGS. 3 and 4. When the position detection patterns 60*f* and 60*r* are transferred to the image position detection unit 50, the reflective optical sensors 51 and 52 detects the position detection patterns 60*f* and 60*r* for determining a misalignment amount to perform the color positional misalignment correction in the step S407. The system controller 71 resumes the interrupted print job upon completing the color positional correction process.

As described above, the color image forming device 1 detects the formed non-image density pattern 80 at the reflective optical sensors 51 and 52. It is then determined whether or not to perform the density adjustment process based upon the detected non-image density value D only when the number of the valid detected non-image density data exceeds the predetermined number N. Thus, the fourth preferred embodiment prevents from determining the erroneous decision based upon a small number of the detected non-image density values D on the non-image density pattern 80 to substantially eliminate the failure for detecting the position detection patterns 60*f* and 60*r*. Thus, the processing efficiency, the image quality and the utilization efficiency all improve.

In alternative embodiments, the non-image density pattern is detected at a time other than the execution time of the color positional misalignment correction process. In one alternative embodiment, the color image forming device 1 detects the formed non-image density pattern 80 at the reflective optical sensors 51 and 52 at any time before the execution time of the color positional misalignment correction process and stores the detected value in a non-volatile memory for later use during the execution time of the color positional misalignment correction process. The above alternative embodiment optionally utilizes the non-image density pattern 80 that is formed during the non-image formation period after the image density adjustment process and is detected by the reflective optical sensors 51 and 52 as valid data. For example, old data is deleted from the non-volatile memory when the image adjustment process is executed. Furthermore, it is optionally determined that the need for the image density adjustment process and the number of the non-image density patterns 80 with respect to the N number are determined in view of only the non-image density patterns that is stored in the non-volatile memory.

Figure 12:
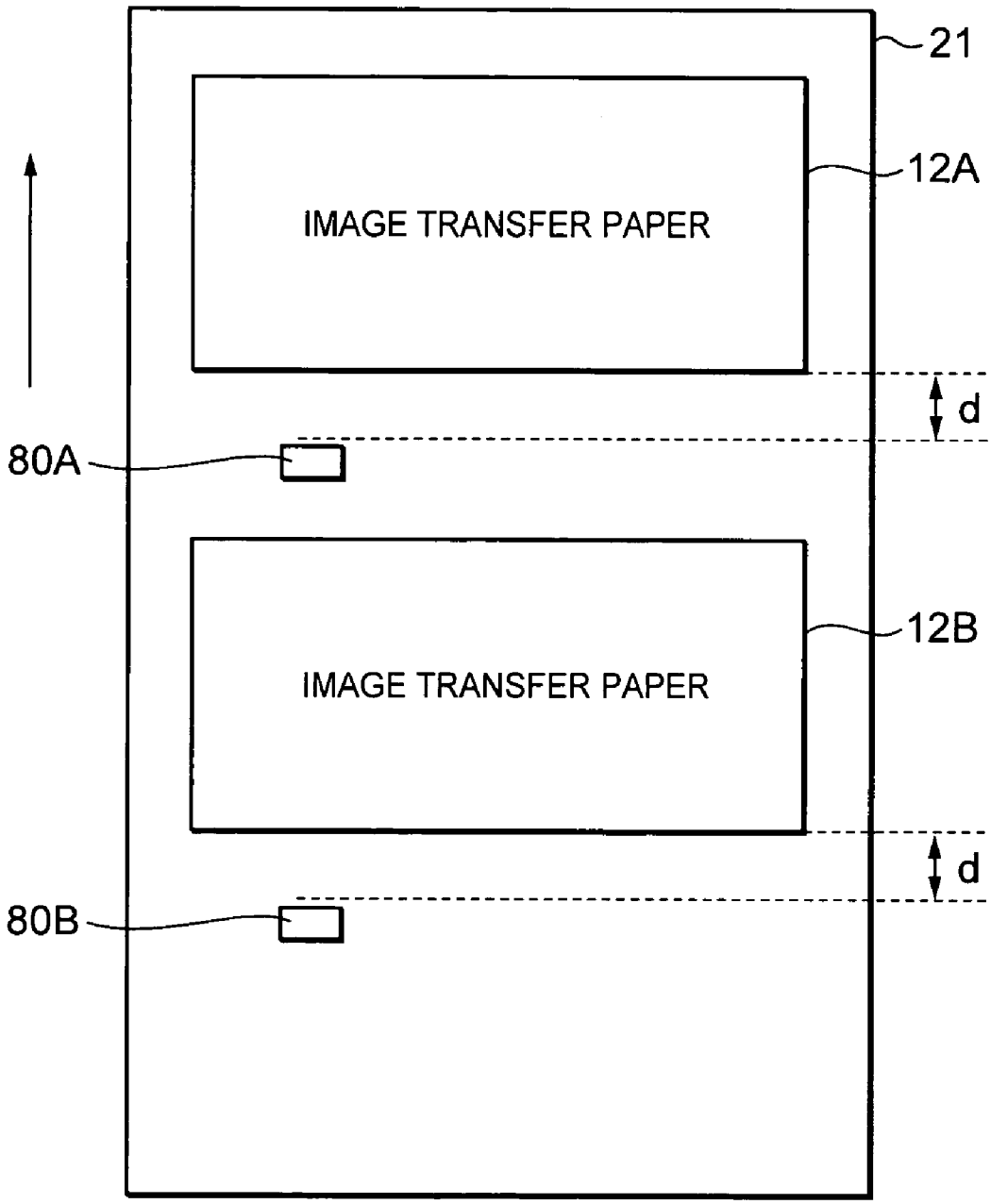
FIG. 12 is a diagram illustrating a positional relationship among adjacent two of the image recording media and a marker as practiced in the current invention.

Now referring to FIG. 12, a diagram illustrates a positional relationship among adjacent two of the image recording media and a marker as practiced in the current invention. Two adjacent image recording media or image transfer paper 12 are placed on the transfer belt 21, which transfers them in the main-running direction as indicated by an arrow. Between the two adjacent image recording media 12, a prior non-image detection pattern 80A is additionally formed at a certain distance d from a trailing end of the two adjacent image recording media 12 in an area outside the image forming area. The reflective optical sensors 51 and 52 of the color image forming device 1 detects the prior non-image detection pattern 80A. As described above, the color positional misalignment correction process is performed by interrupting the normal print tasks when the number of printouts exceeds a predetermined standard number and the internal temperature also exceeds a predetermined temperature. The system controller 71 forms the position detection patterns 60*f* and 60*r* as well as other density detection patterns (not shown in any figures) for the position detection patterns 60*f* and 60*r* on the transfer belt 21. The system controller 71 forms prior non-image density patterns 80A and 80B outside the transfer paper 12A and 12B respectively at the distance d from the transfer paper 12A and 12B during the print process based upon the above density detection patterns. During the normal print process, the density of the prior non-image density patterns 80A and 80B is detected by the image position detection unit 50 in advance of the color positional misalignment correction process. Based upon the above detected results, the system controller 71 prepares to form the position detection patterns 60*f* and 60*r* at a certain expected or normal density level as well as prepares the reflective optical sensors 51 and 52 to detect the position detection patterns 60*f* and 60*r* at the expected or normal density level during the color positional misalignment correction process.

Figure 13:
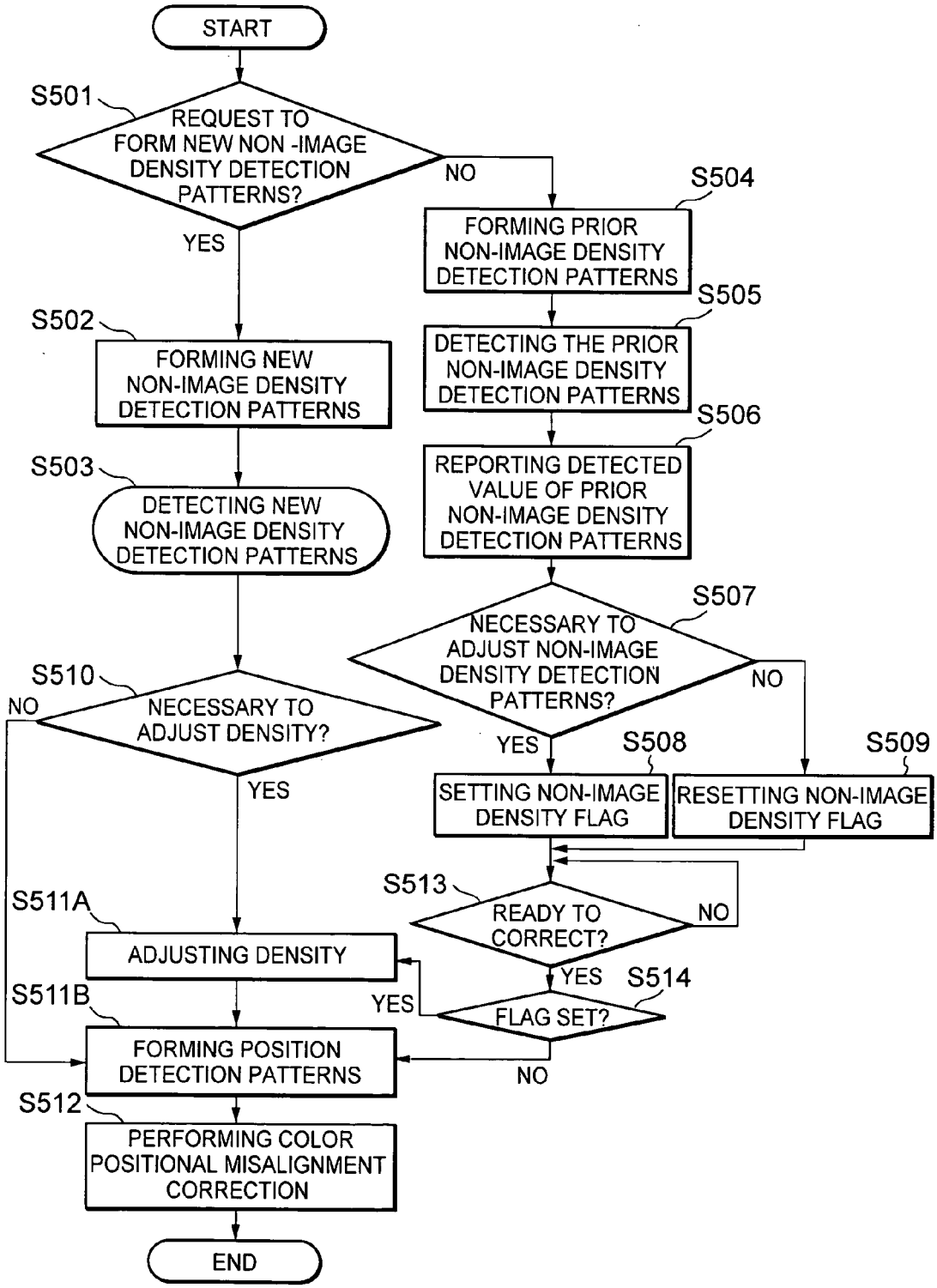
FIG. 13 is a flow chart illustrating steps involved in a fifth preferred process of correcting the color misalignment according to the current invention.

Now referring to FIG. 13, a flow chart illustrates steps involved in a fifth preferred process of correcting the color misalignment according to the current invention. The fifth preferred process is implemented by a fifth preferred embodiment of the color image forming device 1 according to the current invention. The substantially identical units or components are referred to by the same reference numbers between the first and fifth preferred embodiments. In general, the position correcting controller 72 determines in a step S501 whether or not a request exists for generating density detection patterns. If it is determined in the step S501 that a request exists for generating the density detection patterns, the print task is interrupted and the density detection patterns are formed on the transfer belt 21 in a step S502. The image position detection unit 50 detects the formed density detection patterns in a step S503. Based upon the detected density level, it is determined in a step S510 whether or not the density needs to be adjusted. If it is determined in the step S510 that the density needs to be adjusted, the density is adjusted in a step S511A and the position detection patterns 60*f* and 60*r* are formed on the transfer belt 21 based upon the adjusted density level in a step S511B. In a step S512, the position detection patterns 60*f* and 60*r* are detected to determine the adjustment amount for performing the color positional misalignment correction process. On the other hand, if it is determined in the step S510 that the density does not need to be adjusted, the step S511A is skipped and the steps S511B and S512 are performed for forming the detection patterns and for correcting the misalignment.

Still referring to FIG. 13, when no request has been made to form new non-image density patterns in the step S501, the following steps are followed. In a step S504, the prior non-image density patterns 80A and 80B are formed on the transfer belt 21 between the transfer paper 12A and 12B during normal print tasks. The prior non-image density patterns 80A and 80B are detected in a step S505, and the detected density value D of the prior non-image density patterns 80A and 80B is sent to the system controller 71 in a step S506. The system controller 71 determines in a step S507 whether or not the density needs to be adjusted. If it is determined in the step S507 that the density needs to be adjusted, a non-image density flag is set in a step S508. On the other hand, if it is determined in the step S507 that the density does not need to be adjusted, the non-image density flag is reset in a step S509. Subsequently, it is determined in a step S513 whether or not it is ready to interrupt any print job if necessary to perform the color positional misalignment correction process.

To determine the readiness, the detected temperature T from the temperature sensor 78 and the count value P from the print out counter 77 are compared to a respective predetermined value. If it is determined in the step S513 that it is not yet ready to perform the color positional misalignment correction process, the preferred process waits at the step S513. On the other hand, if it is determined in the step S513 that it is ready to perform the color positional misalignment correction process, it is further determined in a step S514 whether or not the non-image density flag has been set in the step S508. If the non-image density flag has not been set in the step S508, the preferred process proceeds to the step S511B, where the position detection patterns 60*f* and 60*r* are formed and the color positional misalignment correction process follows in the step S512. On the other hand, if the non-image density flag has been set in the step S508, the preferred process proceeds to the step S511B where the position detection patterns 60*f* and 60*r* are formed and the color positional misalignment correction process follows in the step S512.

Figure 14:
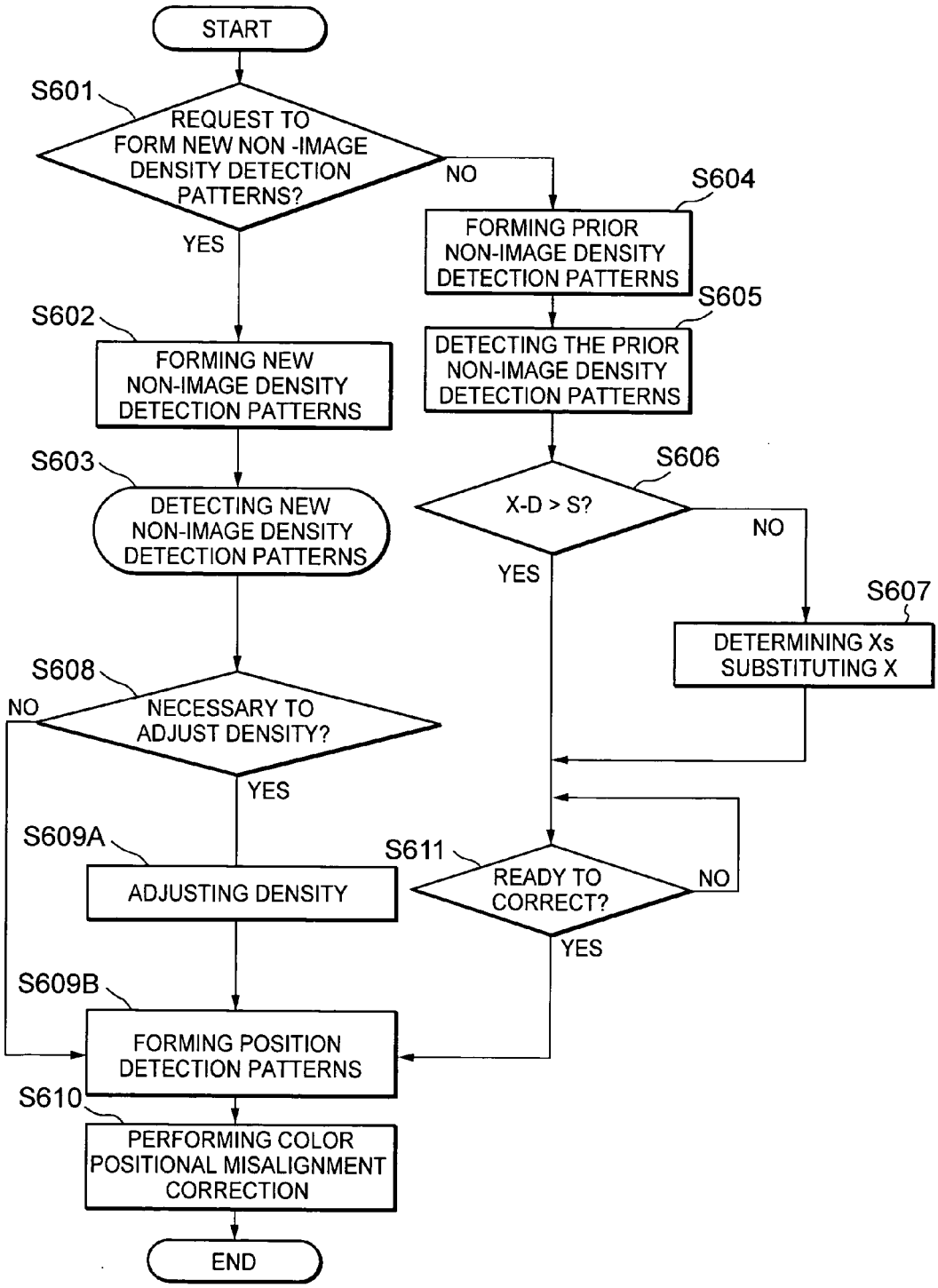
FIG. 14 is a flow chart illustrating steps involved in a sixth preferred process of correcting the color misalignment according to the current invention.

Now referring to FIG. 14, a flow chart illustrates steps involved in a sixth preferred process of correcting the color misalignment according to the current invention.

The sixth preferred process is implemented by a sixth preferred embodiment of the color image forming device 1 according to the current invention. The substantially identical units or components are referred to by the same reference numbers between the first and fifth preferred embodiments. In general, the position correcting controller 72 determines in a step S601 whether or not a request exists for generating density detection patterns. If it is determined in the step S601 that a request exists for generating the density detection patterns, the print task is interrupted and the density detection patterns are formed on the transfer belt 21 in a step S602. The image position detection unit 50 detects the formed density detection patterns in a step S603. Based upon the detected density level, it is determined in a step S108 whether or not the density needs to be adjusted. If it is determined in the step S108 that the density needs to be adjusted, the density is adjusted in a step S601 and the position detection patterns 60*f* and 60*r* are formed on the transfer belt 21 based upon the adjusted density level in a step S602. In a step S601, the position detection patterns 60*f* and 60*r* are detected to determine the adjustment amount for performing the color positional misalignment correction process. On the other hand, if it is determined in the step S108 that the density does not need to be adjusted, the step S601 is skipped and the steps S602 and S601 are performed.

Still referring to FIG. 14, when no request has been made to form new non-image density patterns in the step S601, the following steps are followed. In a step S104, the prior non-image density patterns 80A and 80B are formed on the transfer belt 21 between the transfer paper 12A and 12B during normal print tasks. The prior non-image density patterns 80A and 80B are detected in a step S105, and the detected density value D of the prior non-image density patterns 80A and 80B is subtracted from a predetermined positional misalignment standard value X to determine a difference, and the difference X−D is compared to a predetermined value S in a step S603. If it is determined in the step S603 that X−D is not larger than the predetermined value S, a new value As is determined so that As−D is larger than the predetermined value S, and the value As is substituted into the variable X in a step S107. On the other hand, if it is determined in the step S603 that X−D is larger than the predetermined value S, preferred process skips the step S107. Subsequently, it is determined in a step S601 whether or not it is ready to interrupt any print job if necessary to perform the color positional misalignment correction process. To determine the readiness, the detected temperature T from the temperature sensor 78 and the count value P from the print out counter 77 are compared to a respective predetermined value. If it is determined in the step S601 that it is not yet ready to perform the color positional misalignment correction process, the preferred process waits at the step S601. On the other hand, if it is determined in the step S601 that it is ready to perform the color positional misalignment correction process, the preferred process proceeds to the step S602, where the position detection patterns 60*f* and 60*r* are formed on the transfer belt 21 and detected before performing the color positional misalignment correction process in the step S601.

Figure 15:
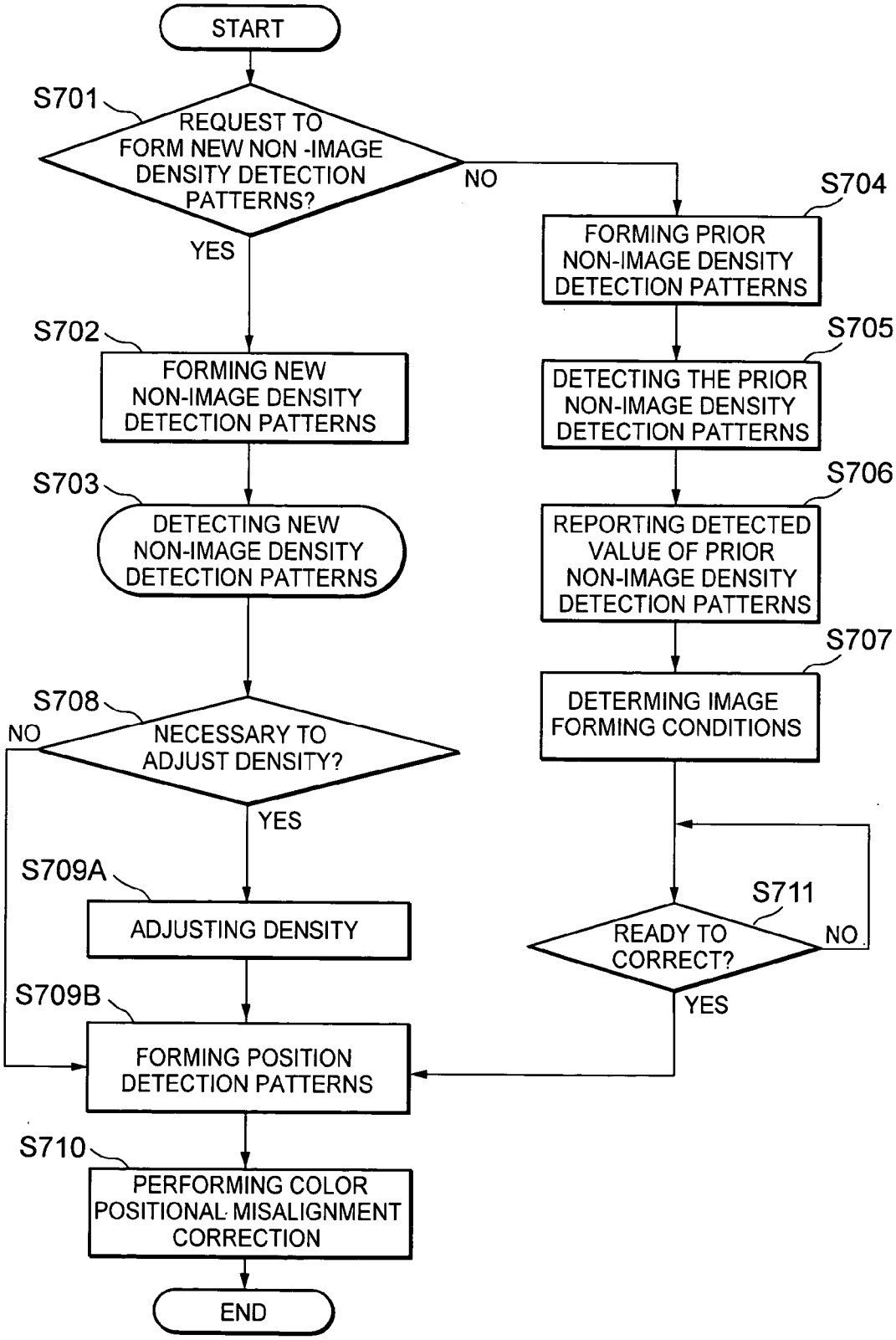
FIG. 15 is a flow chart illustrating steps involved in a seventh preferred process of correcting the color misalignment according to the current invention.

Now referring to FIG. 15, a flow chart illustrates steps involved in a seventh preferred process of correcting the color misalignment according to the current invention. The seventh preferred process is implemented by a seventh preferred embodiment of the color image forming device 1 according to the current invention. The substantially identical units or components are referred to by the same reference numbers between the first and seventh preferred embodiments. In general, the position correcting controller 72 determines in a step Sic whether or not a request exists for generating density detection patterns. If it is determined in the step Sic that a request exists for generating density detection patterns, the print task is interrupted and the density detection patterns are formed on the transfer belt 21 in a step S102. The image position detection unit 50 detects the formed density detection patterns in a step S103. Based upon the detected density level, it is determined in a step S108 whether or not the density needs to be adjusted. If it is determined in the step S108 that the density needs to be adjusted, the density is adjusted in a step S509 and the position detection patterns 60*f* and 60*r* are formed on the transfer belt 21 based upon the adjusted density level in a step S509. In a step Sic, the position detection patterns 60*f* and 60*r* are detected to determine the adjustment amount for performing the color positional misalignment correction process. On the other hand, if it is determined in the step S108 that the density does not need to be adjusted, the step S509 is skipped and the steps S509 and Sic are performed.

Still referring to FIG. 15, when no request has been made to form new non-image density patterns in the step Sic, the following steps are followed. In a step S104, the prior non-image density patterns 80A and 80B are formed on the transfer belt 21 between the transfer paper 12A and 12B during normal print tasks. The prior non-image density patterns 80A and 80B are detected in a step S105, and the detected density value D of the prior non-image density patterns 80A and 80B is sent to the system controller 71 in a step S106. In a step Simi, based upon the detected density value D, the system controller 71 determines an optimal value for the image forming conditions for forming the position detection patterns 60*f* and 60*r* including a charge bias voltage, a developing bias voltage, a transfer bias voltage and a writing optical amount. Subsequently, it is determined in a step Sic whether or not it is ready to interrupt any print job if necessary to perform the color positional misalignment correction process. To determine the readiness, the detected temperature T from the temperature sensor 78 and the count value P from the print out counter 77 are compared to a respective predetermined value. If it is determined in the step Sic that it is not yet ready to perform the color positional misalignment correction process, the preferred process waits at the step Sic. On the other hand, if it is determined in the step Sic that it is ready to perform the color positional misalignment correction process, the preferred process proceeds to the step S509, where the position detection patterns 60*f* and 60*r* are formed on the transfer belt 21 and detected before performing the color positional misalignment correction process in the step Sic.

Figure 16:
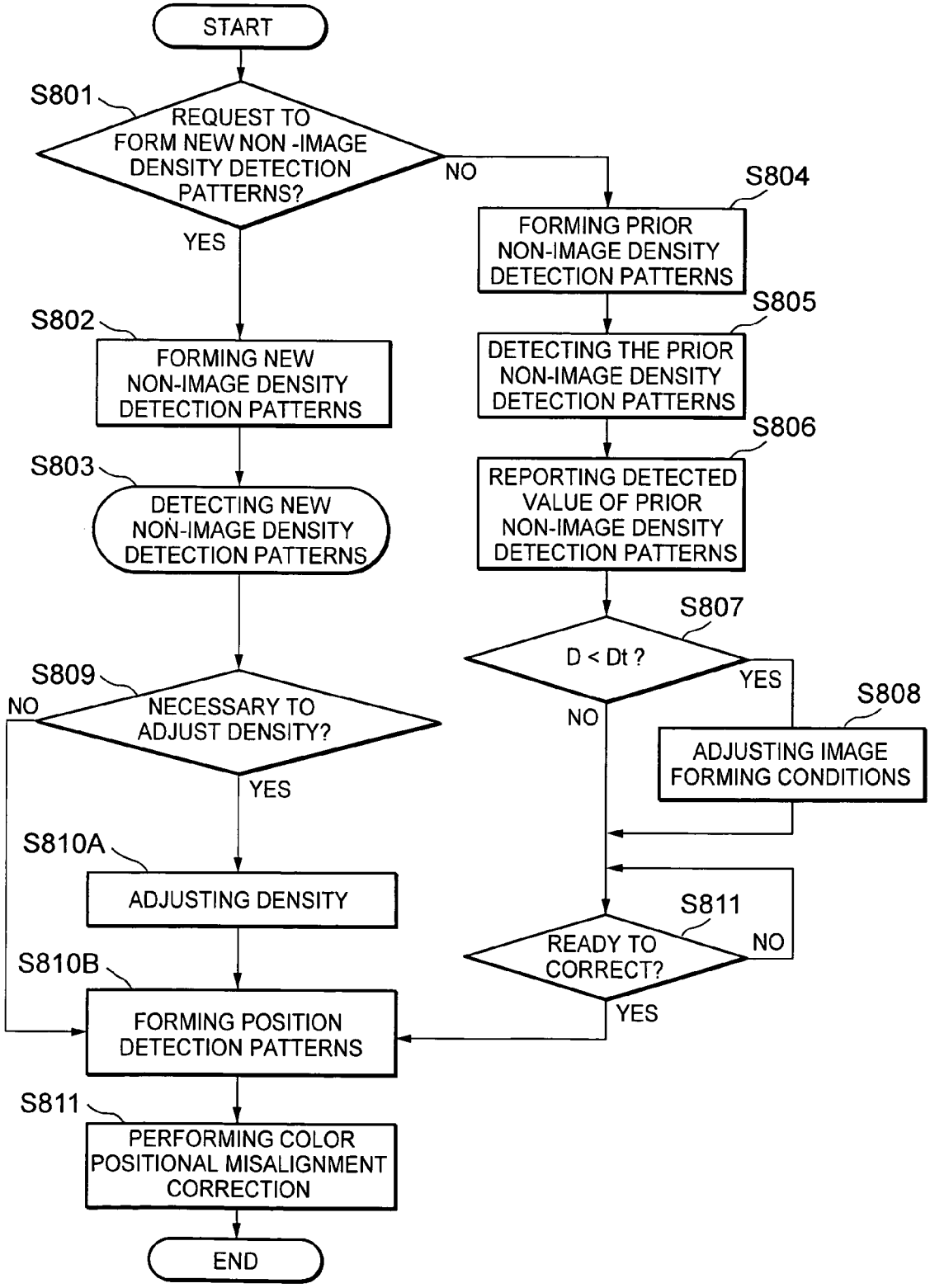
FIG. 16 is a flow chart illustrating steps involved in an eighth preferred process of correcting the color misalignment according to the current invention.

Now referring to FIG. 16, a flow chart illustrates steps involved in an eighth preferred process of correcting the color misalignment according to the current invention. The eighth preferred process is implemented by an eighth preferred embodiment of the color image forming device 1 according to the current invention. The substantially identical units or components are referred to by the same reference numbers between the first and eighth preferred embodiments. In general, the position correcting controller 72 determines in a step S801 whether or not a request exists for generating density detection patterns. If it is determined in the step S801 that a request exists for generating density detection patterns, the print task is interrupted and the density detection patterns are formed on the transfer belt 21 in a step S102. The image position detection unit 50 detects the formed density detection patterns in a step S103. Based upon the detected density level, it is determined in a step S509 whether or not the density needs to be adjusted. If it is determined in the step S509 that the density needs to be adjusted, the density is adjusted in a step S.P.C.A. And the position detection patterns 60*f* and 60*r* are formed on the transfer belt 21 based upon the adjusted density level in a step S810B. In a step S811, the position detection patterns 60*f* and 60*r* are detected to determine the adjustment amount for performing the color positional misalignment correction process. On the other hand, if it is determined in the step S509 that the density does not need to be adjusted, the step S.P.C.A. is skipped and the steps S810B and S811 are performed.

Still referring to FIG. 16, when no request has been made to form new non-image density patterns in the step S801, the following steps are followed. In a step S804, the prior non-image density patterns 80A and 80B are formed on the transfer belt 21 between the transfer paper 12A and 12B during normal print tasks. The prior non-image density patterns 80A and 80B are detected in a step S805, and the detected density value D of the prior non-image density patterns 80A and 80B is sent to the system controller 71 in a step S806. The system controller 71 compares the detected density value D to a predetermined threshold value Dt in a step S807. If it is determined in the step S807 that the detected density value D is smaller than the predetermined threshold value Dt, the existing image forming conditions are adjusted in a step S808. On the other hand, if it is determined in the step S807 that the detected density value D is not smaller than the predetermined threshold value Dt, the preferred process skips the step S808. Subsequently, it is determined in a step S811 whether or not it is ready to interrupt any print job if necessary to perform the color positional misalignment correction process. To determine the readiness, the detected temperature T from the temperature sensor 78 and the count value P from the print out counter 77 are compared to a respective predetermined value. If it is determined in the step S811 that it is not yet ready to perform the color positional misalignment correction process, the preferred process waits at the step S811. On the other hand, if it is determined in the step S811 that it is ready to perform the color positional misalignment correction process, the preferred process proceeds to the step S810B, where the position detection patterns 60*f* and 60*r* are formed on the transfer belt 21 and detected before performing the color positional misalignment correction process in the step S811.

The above described processes or methods are written in a computer software program that is stored in computer-readable media such as a flexible disk, a CD-ROM disk, a DVD-ROM disk or a MO to be later read for practicing the invention. The above software program according to the current invention is also readable or loadable into a computer architecture via a network including the Internet and the intranet.

It is to be understood, however, that even though numerous characteristics and advantages of the present invention have been set forth in the foregoing description, together with details of the structure and function of the invention, the disclosure is illustrative only, and that although changes may be made in detail, especially in matters of shape, size and arrangement of parts, as well as implementation in software, hardware, or a combination of both, the changes are within the principles of the invention to the full extent indicated by the broad general meaning of the terms in which the appended claims are expressed.

What is claimed is:

1. A method of correcting color positional misalignment among multiple color forming units in generating a color image, comprising the steps of:

forming a density pattern on a transfer belt;

detecting the density pattern to determine a density level in said density pattern in advance of correcting color positional misalignment; and correcting the color positional misalignment utilizing the density level in said detecting step.

2. The method of correcting color positional misalignment according to claim 1 wherein said forming step and said detecting step are performed during a print job for generating the color image.

3. The method of correcting color positional misalignment according to claim 1 wherein said forming step and said detecting step are performed before a print job for generating the color image.

4. The method of correcting color positional misalignment according to claim 1 wherein said forming step and said detecting step are performed only after a print job for generating the color image is interrupted.

5. The method of correcting color positional misalignment according to claim 1 wherein said correcting step is performed only when a set of certain predetermined correction conditions are satisfied.

6. The method of correcting color positional misalignment according to claim 5 wherein said predetermined correction conditions include a number of print outs exceeding a predetermined number of pages and an internal temperature of the multiple color forming unit exceeding a predetermined temperature.

7. The method of correcting color positional misalignment according to claim 1 wherein said correcting step is performed only after a predetermined number of said density levels is detected.

8. The method of correcting color positional misalignment according to claim 1 wherein said correcting step is performed only when said density level exceeding a predetermined threshold value.

9. The method of correcting color positional misalignment according to claim 1 wherein said correcting step further comprises additional steps of:

forming positional detection patterns on the transfer belt in accordance with the density level;

detecting the positional detection patterns to generate a detected position signal;

determining a misalignment amount based upon the detected position signal; and correcting the color positional misalignment based upon the misalignment amount.

10. The method of correcting color positional misalignment according to claim 9 wherein said correcting step is performed at each of the multiple color forming units.

11. The method of correcting color positional misalignment according to claim 9 wherein said positional detection patterns include a plurality of sets of marks, each of the sets including multiple marks positioned at a predetermined angle and a predetermined pitch with respect to a transfer direction of the transfer belt.

12. The method of correcting color positional misalignment according to claim 11 wherein the plurality of the sets is duplicated along an edge at both sides of the transfer belt.

13. The method of correcting color positional misalignment according to claim 9 wherein said correcting step further comprises an additional step of determining whether or not image forming conditions for forming said positional detection patterns on the transfer belt are adjusted based upon the density level.

14. The method of correcting color positional misalignment according to claim 9 wherein said correcting step further comprises an additional step of determining whether or not said correcting step is performed based upon said misalignment amount.

15. A method of correcting color positional misalignment among multiple color forming units in generating a color image, comprising the steps of:

determining whether or not a density determination request exists for a density check;

in response to said determining step, performing said density check comprising the steps of forming one of two predetermined density patterns on a transfer belt and detecting the density pattern to determine a density level in said density pattern in advance of correcting color positional misalignment; and correcting the color positional misalignment utilizing the density level in said detecting step.

16. The method of correcting color positional misalignment according to claim 15 wherein said correcting step further comprises additional steps of:

forming positional detection patterns on the transfer belt in accordance with the density level;

detecting the positional detection patterns to generate a detected position signal;

determining a misalignment amount based upon the detected position signal; and correcting the color positional misalignment based upon the misalignment amount.

17. The method of correcting color positional misalignment according to claim 16 wherein in case said density determination request exists, said density check is performed while a print job for generating the color image is interrupted.

18. The method of correcting color positional misalignment according to claim 17 wherein said density patterns are non-image density patterns.

19. The method of correcting color positional misalignment according to claim 17 wherein said correcting step further comprises an additional step of determining whether or not image forming conditions for forming said positional detection patterns on the transfer belt are adjusted based upon the density level.

20. The method of correcting color positional misalignment according to claim 16 wherein in case said density determination request fails to exist, said density check is performed while a print job for generating the color image is uninterrupted.

21. The method of correcting color positional misalignment according to claim 20 wherein said density patterns are prior non-image density patterns.

22. The method of correcting color positional misalignment according to claim 20 wherein said correcting step further comprises an additional step of determining whether or not image forming conditions for forming said positional detection patterns on the transfer belt are adjusted based upon the density level.

23. The method of correcting color positional misalignment according to claim 22 wherein a result in said determining step of adjusting said image forming conditions is stored in a flag.

24. The method of correcting color positional misalignment according to claim 23 wherein said correcting step is performed only when a set of certain predetermined correction conditions are satisfied, said image forming conditions being adjusted based upon the flag.

25. A computer readable medium storing a computer program for correcting color positional misalignment among multiple color forming units in generating a color image, performing the tasks of:

forming a density pattern on a transfer belt;

detecting the density pattern to determine a density level in said density pattern in advance of correcting color positional misalignment; and correcting the color positional misalignment utilizing the density level in said detecting task.

26. The computer readable medium storing a computer program for correcting color positional misalignment according to claim 25 wherein said forming task and said detecting task are performed during a print job for generating the color image.

27. The computer readable medium storing a computer program for correcting color positional misalignment according to claim 25 wherein said forming task and said detecting task are performed before a print job for generating the color image.

28. The computer readable medium storing a computer program for correcting color positional misalignment according to claim 25 wherein said forming task and said detecting task are performed only after a print job for generating the color image is interrupted.

29. The computer readable medium storing a computer program for correcting color positional misalignment according to claim 25 wherein said correcting task is performed only when a set of certain predetermined correction conditions are satisfied.

30. The computer readable medium storing a computer program for correcting color positional misalignment according to claim 29 wherein said predetermined correction conditions include a number of print outs exceeding a predetermined number of pages and an internal temperature of the multiple color forming unit exceeding a predetermined temperature.

31. The computer program computer readable medium storing a for correcting color positional misalignment according to claim 25 wherein said correcting task is performed only after a predetermined number of said density levels is detected.

32. The computer readable medium storing a computer program for correcting color positional misalignment according to claim 25 wherein said correcting task is performed only when said density level exceeding a predetermined threshold value.

33. The computer readable medium storing a computer program for correcting color positional misalignment according to claim 25 wherein said correcting task further comprises additional tasks of:

forming positional detection patterns on the transfer belt in accordance with the density level;

detecting the positional detection patterns to generate a detected position signal;

determining a misalignment amount based upon the detected position signal; and correcting the color positional misalignment based upon the misalignment amount.

34. The computer readable medium storing a computer program for correcting color positional misalignment according to claim 33 wherein said correcting task is performed at each of the multiple color forming units.

35. The computer readable medium storing a computer program for correcting color positional misalignment according to claim 33 wherein said positional detection patterns include a plurality of sets of marks, each of the sets including multiple marks positioned at a predetermined angle and a predetermined pitch with respect to a transfer direction of the transfer belt.

36. The computer readable medium storing a computer program for correcting color positional misalignment according to claim 35 wherein the plurality of the sets is duplicated along an edge at both sides of the transfer belt.

37. The computer readable medium storing a computer program for correcting color positional misalignment according to claim 33 wherein said correcting task further comprises an additional task of determining whether or not image forming conditions for forming said positional detection patterns on the transfer belt are adjusted based upon the density level.

38. The computer readable medium storing a computer program for correcting color positional misalignment according to claim 33 wherein said correcting task further comprises an additional task of determining whether or not said correcting task is performed based upon said misalignment amount.

39. A computer readable medium storing a computer program for correcting color positional misalignment among multiple color forming units in generating a color image, performing the tasks of:

determining whether or not a density determination request exists for a density check;

in response to said determining task, performing said density check comprising the tasks of forming one of two predetermined density patterns on a transfer belt and detecting the density pattern to determine a density level in said density pattern in advance of correcting color positional misalignment; and correcting the color positional misalignment utilizing the density level in said detecting task.

40. The computer readable medium storing a computer program for correcting color positional misalignment according to claim 39 wherein said correcting task further comprises additional tasks of:

forming positional detection patterns on the transfer belt in accordance with the density level;

detecting the positional detection patterns to generate a detected position signal;

determining a misalignment amount based upon the detected position signal; and correcting the color positional misalignment based upon the misalignment amount.

41. The computer readable medium storing a computer program for correcting color positional misalignment according to claim 40 wherein in case said density determination request exists, said density check is performed while a print job for generating the color image is interrupted.

42. The computer readable medium storing a computer program for correcting color positional misalignment according to claim 41 wherein said density patterns are non-image density patterns.

43. The computer readable medium storing a computer program for correcting color positional misalignment according to claim 41 wherein said correcting task further comprises an additional task of determining whether or not image forming conditions for forming said positional detection patterns on the transfer belt are adjusted based upon the density level.

44. The computer readable medium storing a computer program for correcting color positional misalignment according to claim 40 wherein in case said density determination request fails to exist, said density check is performed while a print job for generating the color image is uninterrupted.

45. The computer readable medium storing a computer program for correcting color positional misalignment according to claim 44 wherein said density patterns are prior non-image density patterns.

46. The computer readable medium storing a computer program for correcting color positional misalignment according to claim 44 wherein said correcting task further comprises an additional task of determining whether or not image forming conditions for forming said positional detection patterns on the transfer belt are adjusted based upon the density level.

47. The computer readable medium storing a computer program for correcting color positional misalignment according to claim 46 wherein a result in said determining task of adjusting said image forming conditions is stored in a flag.

48. The computer readable medium storing a computer program for correcting color positional misalignment according to claim 47 wherein said correcting task is performed only when a set of certain predetermined correction conditions are satisfied, said image forming conditions being adjusted based upon the flag.

49. An apparatus for correcting color positional misalignment among multiple color forming units in generating a color image, comprising:

a memory unit for storing information;

image forming units for respectively forming the color image in a predetermined color in a successively overlapping manner;

a position correcting controller connected to said memory for initiating a density check to determine a density level among said image forming units, said position correcting controller storing the density level in said memory; and a system controller connected to said position correcting controller and said image forming units for correcting the color positional misalignment utilizing the stored density level.

50. The apparatus for correcting color positional misalignment according to claim 49 wherein said image forming units forms a non-image density pattern and claim 49 further comprising a detector ultimately connected to said position correcting controller for detecting the density level of the non-image density pattern.

51. The apparatus for correcting color positional misalignment according to claim 49 wherein said system controller corrects the color positional misalignment during a print job for generating the color image.

52. The apparatus for correcting color positional misalignment according to claim 49 herein said system controller corrects the color positional misalignment before a print job for generating the color image.

53. The apparatus for correcting color positional misalignment according to claim 49 wherein said system controller corrects the color positional misalignment only after a print job for generating the color image is interrupted.

54. The apparatus for correcting color positional misalignment according to claim 49 wherein said system controller corrects the color positional misalignment only when a set of certain predetermined correction conditions are satisfied.

55. The apparatus for correcting color positional misalignment according to claim 54 further comprising:

a print counter connected to said position correcting controller for counting a number of print outs to see if exceeding a predetermined number of pages; and a temperature monitor connected to said position correcting controller for monitoring an internal temperature of said image forming units to see if exceeding a predetermined temperature, the predetermined correction conditions including the number of the print outs and the internal temperature.

56. The apparatus for correcting color positional misalignment according to claim 49 wherein said system controller corrects the color positional misalignment only after a predetermined number of the density levels is detected.

57. The apparatus for correcting color positional misalignment according to claim 49 wherein said system controller corrects the color positional misalignment only when said density level exceeding a predetermined threshold value.

58. The apparatus for correcting color positional misalignment according to claim 50 wherein said image forming units respectively forms positional detection patterns on a transfer belt in accordance with the density level, said detector detecting the positional detection patterns to generate a detected position signal, said position correcting controller determining a misalignment amount based upon the detected position signal, said system controller correcting the color positional misalignment based upon the misalignment amount.

* * * * *